US010761447B2

(12) United States Patent
Yamamoto

(10) Patent No.: US 10,761,447 B2
(45) Date of Patent: Sep. 1, 2020

(54) PHOTOSENSITIVE UNIT

(71) Applicant: CANON KABUSHIKI KAISHA, Tokyo (JP)

(72) Inventor: Tatsuyuki Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/573,534

(22) Filed: Sep. 17, 2019

(65) Prior Publication Data

US 2020/0096891 A1 Mar. 26, 2020

(30) Foreign Application Priority Data

Sep. 26, 2018 (JP) ..... 2018-179899

(51) Int. Cl.
*G03G 15/20* (2006.01)
*G03G 15/02* (2006.01)

(52) U.S. Cl.
CPC ..... *G03G 15/0216* (2013.01)

(58) Field of Classification Search
CPC ..... G03G 15/0216; G03G 15/0225; G03G 15/0233
See application file for complete search history.

(56) References Cited

U.S. PATENT DOCUMENTS 5,585,896 A * 12/1996 Yamazaki ..... G03G 15/0216 361/221
5,596,395 A * 1/1997 Sawamura ..... G03G 15/0216 361/221
5,666,608 A * 9/1997 Christensen ..... G03G 15/0216 399/115
6,385,420 B1 * 5/2002 Morioka ..... G03G 15/0216 399/115
7,570,901 B2 * 8/2009 Choi ..... G03G 15/02 399/115
7,865,115 B2 1/2011 Oguma et al.
8,210,530 B1 * 7/2012 Gayne ..... G03G 15/0813 271/273
8,301,058 B2 * 10/2012 Kim ..... G03G 21/1821 399/100

(Continued)

FOREIGN PATENT DOCUMENTS

JP 2007-286455 A 11/2007
JP 2007-322873 A 12/2007
JP 2012-018265 A 1/2012

*Primary Examiner* — David J Bolduc
(74) *Attorney, Agent, or Firm* — Venable LLP

(57) ABSTRACT

A photosensitive unit includes a rotatable photosensitive member, a frame, a charging roller, an urging portion, a rotary member, a separation member, an abutting portion, and an abutted portion. The separation member includes an engagement portion capable of engaging with the rotary member. The separation member is configured to hold the charging roller at a separation position in a state in which the engagement portion is engaged with the rotary member. The abutting portion is provided on the separation member. The abutted portion is provided on the frame and is abutted by the abutting portion in a case in which the separation member moves in a direction to increase a distance between a swing center of the separation member and a rotation center of the rotary member in a state in which the engagement portion is engaged with the rotary member.

13 Claims, 16 Drawing Sheets

(56) References Cited

U.S. PATENT DOCUMENTS

| | | | | |
|---|---|---|---|---|
| 9,002,234 | B2 | 4/2015 | Shirayanagi | |
| 2007/0098438 | A1* | 5/2007 | Yamaguchi | G03G 21/1857 399/111 |
| 2007/0140709 | A1* | 6/2007 | Yoshida | G03G 21/1896 399/12 |
| 2007/0248382 | A1* | 10/2007 | Oguma | G03G 15/0216 399/167 |
| 2012/0269545 | A1* | 10/2012 | Morita | G03G 21/1825 399/111 |
| 2013/0121725 | A1* | 5/2013 | Shirayanagi | G03G 21/1814 399/111 |
| 2014/0086630 | A1* | 3/2014 | Kitajima | G03G 15/0233 399/111 |
| 2016/0209803 | A1* | 7/2016 | Katayama | G03G 21/1661 |
| 2016/0216688 | A1* | 7/2016 | Katayama | G03G 21/1814 |
| 2016/0252878 | A1* | 9/2016 | Kimura | G03G 21/1803 399/176 |
| 2018/0024473 | A1* | 1/2018 | Yamaguchi | G03G 15/1685 399/121 |
| 2019/0317446 | A1* | 10/2019 | Imanaka | G03G 15/0225 |

* cited by examiner

PHOTOSENSITIVE UNIT

BACKGROUND OF THE INVENTION

Field of the Invention

The present invention relates to a photosensitive unit including a photosensitive member.

Description of the Related Art

A configuration that a photosensitive unit in which parts such as a photosensitive member, for example, a photosensitive drum, and a charging roller that charges the surface of the photosensitive member are unitized is attachable to and detachable from an apparatus body of an image forming apparatus is conventionally known. In the case of a system in which a photosensitive member is charged by bringing a charging roller into contact with the photosensitive member, the charging roller is deformed when the charging roller is left in contact with the photosensitive member for a long period. Therefore, a configuration in which the photosensitive member is separated from the charging roller until the photosensitive unit is attached to the apparatus body is also conventionally known.

For example, Japanese Patent Laid-Open No. 2012-18265 proposes a configuration in which a separation member that separates a charging roller from a photosensitive member against an urging force urging the charging roller toward the photosensitive member is disposed between the photosensitive member and the charging roller. The configuration disclosed in Japanese Patent Laid-Open No. 2012-18265 includes a gear serving as a rotary member that rotates together with the photosensitive member, and the photosensitive member and the charging roller are separated from each other by engaging an engagement portion of the separation member with the gear. Further, the separation state of the charging roller and the photosensitive member by the separation member is cancelled by releasing the engagement between the gear and the separation member by rotating the gear together with the photosensitive member.

There is a case where a vibration is applied to the photosensitive unit during transportation of the photosensitive unit, and thus the separation member is moved to release the engagement between the separation member and the gear. Therefore, in the configuration disclosed in Japanese Patent Laid-Open No. 2012-18265, the separation member includes a concave portion, and in the separation state, movement of the separation member caused by the vibration is suppressed by causing the concave portion to abut a photosensitive drum serving as the photosensitive member.

However, in the case of the configuration disclosed in Japanese Patent Laid-Open No. 2012-18265, there is a risk that, in the case where a strong vibration is applied to the photosensitive unit and the separation member is moved in a direction away from the gear, the engagement between the engagement portion of the separation member and the gear is released and cancellation of the separation state of the photosensitive member and the charging roller cannot be prevented.

SUMMARY OF THE INVENTION

According to a first aspect of the invention, a photosensitive unit includes a rotatable photosensitive member, a frame configured to hold the photosensitive member, a charging roller provided to be movable between a contact position and a separation position and configured to charge a surface of the photosensitive member by being subjected to application of a voltage at the contact position, the charging roller being in contact with the surface of the photosensitive member at the contact position and being separated from the surface of the photosensitive member at the separation position, an urging portion configured to urge the charging roller in a direction from the separation position toward the contact position, a rotary member configured to rotate by receiving input of a driving force, a separation member including an engagement portion capable of engaging with the rotary member, wherein the separation member is configured to hold the charging roller at the separation position against an urging force of the urging portion in a state in which the engagement portion is engaged with the rotary member, and, in a case where the rotary member rotates, the separation member swings in accordance with rotation of the rotary member, engagement between the engagement portion and the rotary member is released, and a state in which the charging roller is held at the separation position is cancelled, an abutting portion provided on the separation member, and an abutted portion that is provided on the frame and that the abutting portion abuts in a case where the separation member moves in a direction to increase a distance between a swing center of the separation member and a rotation center of the rotary member in a state in which the engagement portion is engaged with the rotary member.

According to a second aspect to the invention, a photosensitive unit includes a rotatable photosensitive member, a charging roller provided to be movable between a contact position and a separation position and configured to charge a surface of the photosensitive member by being subjected to application of a voltage at the contact position, the charging roller being in contact with the surface of the photosensitive member at the contact position and being separated from the surface of the photosensitive member at the separation position, an urging portion configured to urge the charging roller in a direction from the separation position toward the contact position, a rotary member configured to rotate by receiving input of a driving force, a separation member including an engagement portion capable of engaging with the rotary member, wherein the separation member is configured to hold the charging roller at the separation position against an urging force of the urging portion in a state in which the engagement portion is engaged with the rotary member, and, in a case where the rotary member rotates, the separation member moves in accordance with rotation of the rotary member, engagement between the engagement portion and the rotary member is released, and a state in which the charging roller is held at the separation position is cancelled, and a regulation portion configured to, in a state in which the engagement portion is engaged with the rotary member, regulate movement of the separation member in such a direction that the separation member moves away from a rotation center of the rotary member in a radial direction of the rotary member, such that the engagement between the engagement portion and the rotary member is not released.

Further features of the present invention will become apparent from the following description of exemplary embodiments with reference to the attached drawings.

DESCRIPTION OF THE EMBODIMENTS

First Exemplary Embodiment

Figure 1:
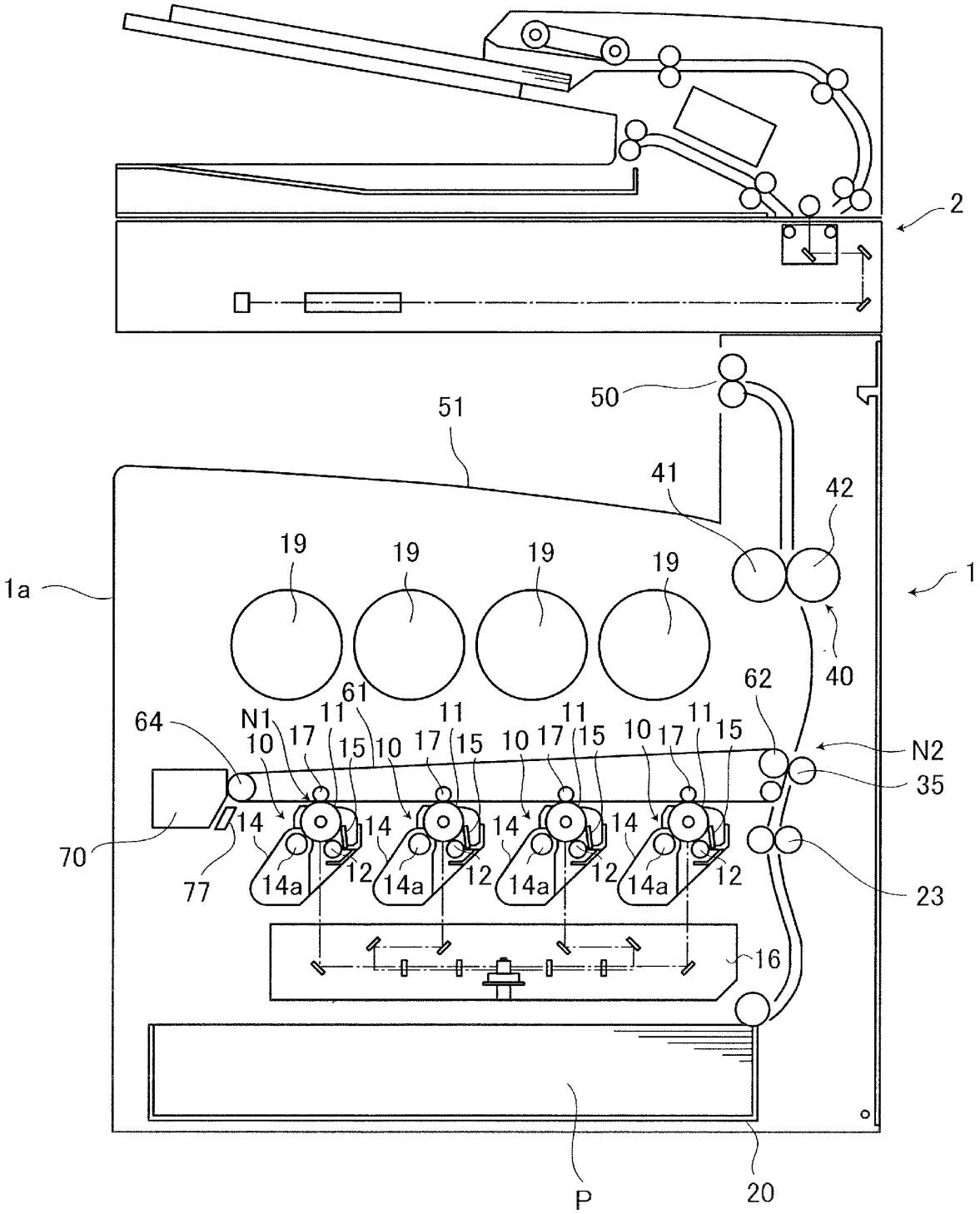
FIG. 1 is a schematic section view of an image forming apparatus according to a first exemplary embodiment illustrating a configuration thereof.

A first exemplary embodiment of the present invention will be described with reference to FIGS. 1 to 11B. First, a schematic configuration of an image forming apparatus of the present exemplary embodiment will be described with reference to FIG. 1.

Image Forming Apparatus

An image forming apparatus 1 is an image forming apparatus of a tandem type which is capable of forming a full-color image using an electrophotographic system and in which an intermediate transfer system is employed. That is, the image forming apparatus 1 includes image forming portions 10 of respective colors of Y, M, C, and K, and has a so-called tandem type configuration in which these image forming portions 10 of respective colors are arranged in a rotation direction of an intermediate transfer belt 61. Y, M, C, and K respectively represent yellow, magenta, cyan, and black. The configurations and operations of the image forming portions 10 are substantially the same except that the colors of used toners are different.

The image forming portions 10 each include a photosensitive drum 11 that is an electrophotographic photosensitive member having a cylindrical shape. The photosensitive drum 11 receives a driving force transmitted from an unillustrated driving portion provided in an apparatus body 1*a*, and is thus rotationally driven at a process speed of 100 mm/sec, which is a peripheral speed. In each of the image forming portion 10, a charging roller 12, a developing unit 14, a primary transfer roller 17, and a drum cleaning unit 15 are arranged in the vicinity of the photosensitive drum 11 in this order along a rotation direction of the photosensitive drum 11. An exposing unit 16 is disposed below the image forming portions 10. In addition, the image forming apparatus 1 includes the intermediate transfer belt 61 provided so as to be in contact with the photosensitive drums 11 of the image forming portions 10 and formed as an endless belt body serving as an intermediate transfer member.

The charging roller 12 serving as a charging member is a rotatable roller-shaped charging member, is disposed to be in contact with the photosensitive drum 11, and charges the surface of the photosensitive drum 11. The exposing unit 16 serving as an exposing portion exposes the charged surface of the photosensitive drum 11 to form an electrostatic latent image on the photosensitive drum 11. The exposing unit 16 is a laser scanner unit in the present exemplary embodiment.

The developing unit 14 accommodates toner serving as developer therein, and develops, as a toner image and by using the toner, the electrostatic latent image formed on the photosensitive drum 11. The developing unit 14 having such a configuration includes a developing sleeve 14*a* serving as a developer bearing member that bears the toner and conveys the toner to an opposing portion, that is, a developing position of the photosensitive drum 11. The developing sleeve 14*a* is rotationally driven.

The primary transfer roller 17 is a roller-shaped primary transfer member, and transfers the toner image formed on the photosensitive drum 11 onto the intermediate transfer belt 61 through primary transfer. The drum cleaning unit 15 cleans transfer residual toner and the like remaining on the photosensitive drum 11 after the primary transfer.

The intermediate transfer belt 61 is formed as an endless belt from a dielectric resin such as polyimide. The intermediate transfer belt 61 is stretched over a plurality of support rollers serving as stretching rollers by a predetermined tension. The primary transfer rollers 17 described above are disposed at positions opposing the respective photosensitive drums 11 on the inner peripheral surface side, that is, the back surface side of the intermediate transfer belt 61. The primary transfer rollers 17 are pressed against the photosensitive drums 11 with the intermediate transfer belt 61 therebetween, and form primary transfer portions N1, that is, primary transfer nip portions N1, where the intermediate transfer belt 61 is in contact with the photosensitive drums 11. The primary transfer rollers 17 are rotationally driven in accordance with the rotation of the intermediate transfer belt 61.

In addition, a secondary transfer roller 35 serving as a roller-shaped secondary transfer member is disposed on the outer peripheral surface side, that is, the front surface side of the intermediate transfer belt 61 at a position opposing a secondary transfer opposing roller 62. The secondary transfer roller 35 is pressed against the secondary transfer opposing roller 62 with the intermediate transfer belt 61 therebetween, and forms a secondary transfer portion N2, that is, secondary transfer nip portion N2, where the intermediate transfer belt 61 and the secondary transfer roller 35 are in contact with each other. The toner images transferred onto the intermediate transfer belt 61 are transferred onto a recording material P through secondary transfer at the secondary transfer portion N2.

In addition, a belt cleaning unit 70 serving as an intermediate transfer member cleaning portion is disposed on the outer peripheral surface side of the intermediate transfer belt 61 at a position opposing a tension roller 64. The belt cleaning unit 70 cleans transfer residual toner and the like remaining on the intermediate transfer belt 61 after secondary transfer.

Next, an image forming operation will be described. At the time of image formation, the surface of the photosensitive drum 11 that is rotationally driven is uniformly charged to a predetermined potential of a predetermined polarity by the charging roller 12. In the present exemplary embodiment, only a direct current voltage of −1300 V is applied to the charging roller 12 from an unillustrated high-voltage power source serving as a charging power source, thus electrical discharge to the surface of the photosensitive drum 11 occurs, and the surface of the photosensitive drum 11 is charged to about −700V.

After the surface of the photosensitive drum 11 is uniformly charged, the surface of the photosensitive drum 11 is scanned and exposed by the exposing unit 16 in accordance with a signal of image information, and an electrostatic latent image, that is, an electrostatic image is formed on the surface of the photosensitive drum 11. To be noted, the image forming apparatus 1 of the present exemplary embodiment includes an image reading apparatus 2, and examples of the image information include image information of a document read by the image reading apparatus 2 and image information transmitted from an external terminal such as a personal computer connected to the image forming apparatus 1.

The electrostatic latent image formed on the photosensitive drum 11 is developed as a toner image by the developing unit 14 by using the toner serving as developer. In the present exemplary embodiment, the normal charging polarity of the toner is a negative polarity. At the time of development, a predetermined developing voltage serving as a developing bias is applied to the developing sleeve 14*a* from an unillustrated high-voltage power source serving as a developing power source. As the developing voltage, an oscillatory voltage in which a direct current voltage serving as a direct current component and an alternate current voltage serving as an alternate current component are superimposed on each other is used. In addition, the toner is supplied to the developing unit 14 from a toner bottle 19 serving as a toner container through an unillustrated toner conveyance path.

The toner image formed on the photosensitive drum 11 is transferred onto the surface of the intermediate transfer belt 61 through primary transfer at the primary transfer portion N1 by an action of the primary transfer roller 17. At this time, a primary transfer voltage serving as a primary transfer bias that is a direct current voltage of a polarity opposite to the charging polarity of the toner at the time of development is applied to the primary transfer roller 17 from an unillustrated primary transfer power source that is a high-voltage power source. In the present exemplary embodiment, the polarity of the primary transfer voltage is a positive polarity. When forming a full-color image, the operation described above is performed in each of the image forming portions 10, and toner images of yellow, magenta, cyan, and black formed on the respective photosensitive drums 11 are sequentially transferred onto the intermediate transfer belt 61 so as to be superimposed on one another. After the transfer, transfer residual toner of a small amount remaining on the photosensitive drums 11 is removed by the drum cleaning units 15 and collected by collecting portions.

Meanwhile, recording materials P are fed one by one from a feeding cassette 20, and conveyed to a registration roller pair 23. Each recording material P is, for example, a sheet such as a paper sheet or a plastic sheet. Then, the registration roller pair 23 conveys the recording material P to the nip between the intermediate transfer belt 61 and the secondary transfer roller 35 at a timing matching conveyance of a toner image on the intermediate transfer belt 61.

The color toner image on the intermediate transfer belt 61 is transferred onto the surface of the recording material P through secondary transfer at the secondary transfer portion N2 by an action of the secondary transfer roller 35. When the recording material P passes through the secondary transfer portion N2, a secondary transfer voltage serving as a secondary transfer bias that is a direct current voltage of a polarity opposite to the charging polarity of the toner at the time of development is applied to the secondary transfer roller 35 from an unillustrated secondary transfer power source that is a high-voltage power source. After the transfer, transfer residual toner of a small amount remaining on the intermediate transfer belt 61 is removed and collected by the belt cleaning unit 70 to prepare for the next image formation.

The toner image transferred onto the recording material P is fixed by being heated and pressurized in a nip portion formed by a heating roller 41 and a pressurizing roller 42 of a fixing unit 40, and the recording material P is discharged onto a discharge tray 51 by a discharge roller pair 50.

Drum Cartridge

Next, a schematic configuration of a drum cartridge 100 serving as a photosensitive unit will be described with reference to FIGS. 2 to 4. In the present exemplary embodiment, the drum cartridge 100 including the photosensitive drum 11 is configured to be attachable to and detachable from the apparatus body 1*a* illustrated in FIG. 1 such that the drum cartridge 100 including the photosensitive drum 11 can be replaced in maintenance or the like. For example, the drum cartridge 100 is configured to be attachable to and detachable from the apparatus body 1*a* by moving the drum cartridge 100 in a longitudinal direction of the apparatus body 1*a*, that is, in a rotation axis direction of the photosensitive drum 11.

Figure 2:
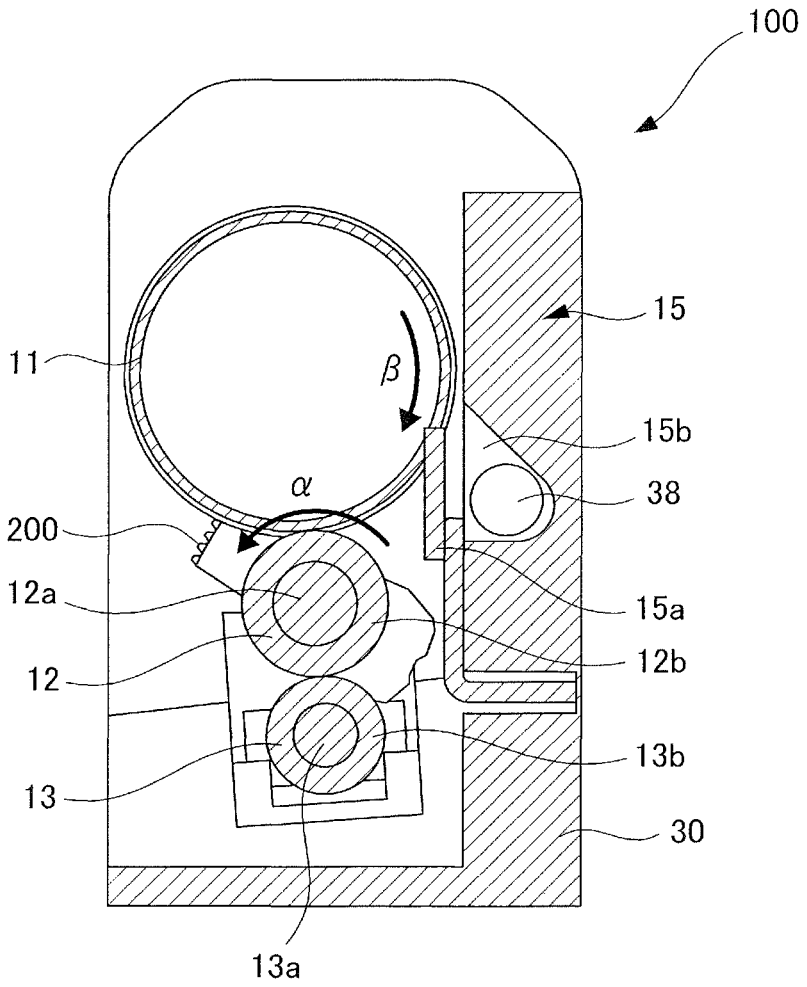
FIG. 2 is a schematic section view of a drum unit according to the first exemplary embodiment illustrating a configuration thereof.

As illustrated in FIG. 2, the drum cartridge 100 includes the photosensitive drum 11 serving as a photosensitive member, the charging roller 12, the cleaning roller 13 serving as a cleaning member, the drum cleaning unit 15, a separation member 200, and so forth. These are held in an integrated manner by a drum container 30 serving as a frame.

In the drum container 30, the photosensitive drum 11 is held via an unillustrated bearing so as to be rotatable around a rotation axis thereof. That is, as illustrated in FIG. 3, the drum container 30 includes side walls 30*a* disposed on both sides of rotation axes of the photosensitive drum 11, the charging roller 12, and the cleaning roller 13, and a connecting portion 30*b* interconnecting the side walls 30*a*. Further, both end portions of the photosensitive drum 11 in the rotation axis direction thereof are rotatably held by the respective side walls 30*a* on both sides in the rotation axis direction via bearings.

Figure 4:
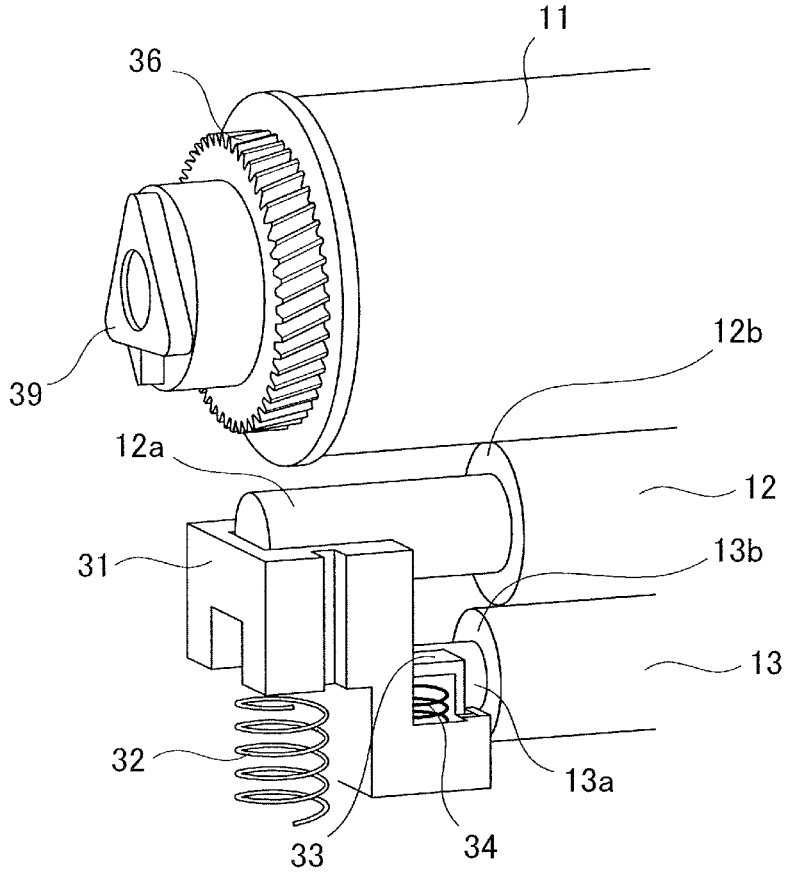
FIG. 4 is a partial perspective view of the drum unit according to the first exemplary embodiment which illustrates the contact state thereof and in which the regulation portion, a separation member, and a frame are omitted.
Figure 5:
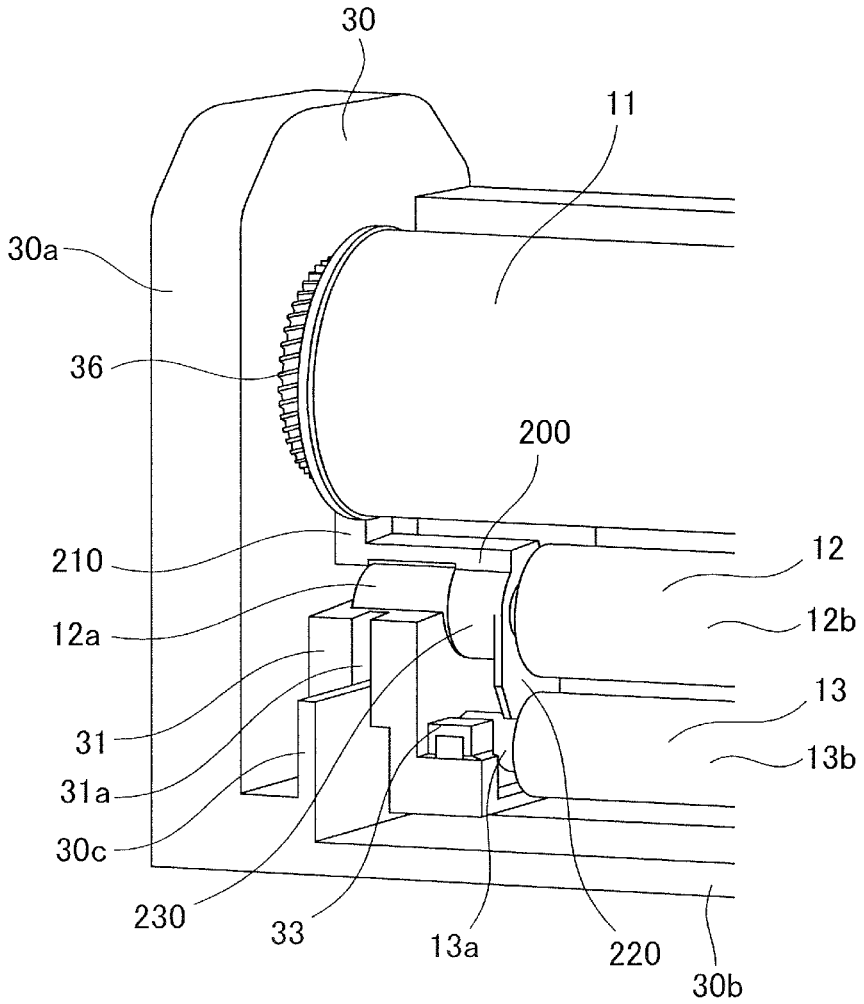
FIG. 5 is a partial perspective view of the drum unit according to the first exemplary embodiment which illustrates a separation state thereof and in which the regulation portion is omitted.
Figure 6:
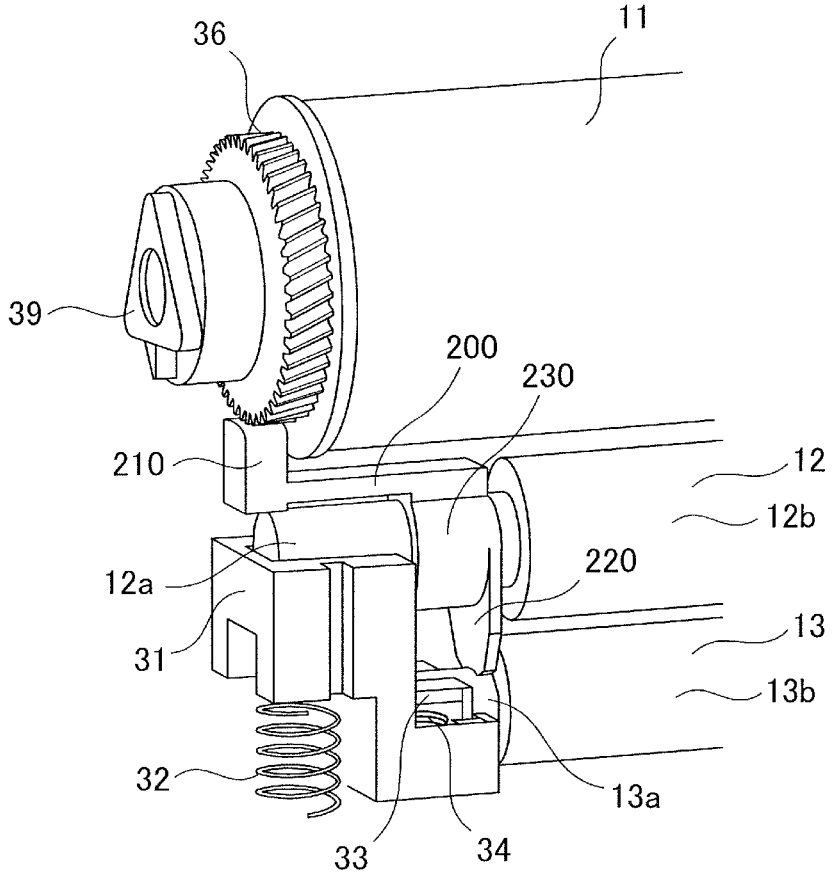
FIG. 6 is a partial perspective view of the drum unit according to the first exemplary embodiment which illustrates the separation state thereof and in which the regulation portion and the frame are omitted.

In addition, a coupling 39 illustrated in FIG. 4 for receiving a driving force from an unillustrated motor serving as a drive source and provided in the apparatus body 1*a* to rotate in a state of being attached to the apparatus body 1*a* is provided on the photosensitive drum 11. When the drum cartridge 100 is attached to the apparatus body 1*a*, the coupling 39 is coupled to a coupling provided on the apparatus body 1*a* and receives the driving force transmitted from the motor provided in the apparatus body 1*a*.

In addition, the drum container 30 includes the drum cleaning unit 15, and the drum cleaning unit 15 includes a cleaning blade 15*a*, a collection portion 15*b*, and a toner conveyance screw 38. The cleaning blade 15*a* is fixed to the drum container 30, abuts the surface of the photosensitive drum 11 in a counter direction with respect to a rotation direction β in which the photosensitive drum 11 rotates during image formation, and thus cleans the surface of the photosensitive drum 11.

In addition, the collection portion 15*b* is provided in the vicinity of the cleaning blade 15*a*, and collects transfer residual toner removed from the surface of the photosensitive drum 11 by the cleaning blade 15*a*. The toner conveyance screw 38 serving as a conveyance portion conveys the toner collected by the collection portion 15*b* to the outside of the drum cartridge 100. The toner conveyed to the outside of the drum cartridge 100 by the toner conveyance screw 38 is collected in an unillustrated waste toner container provided in the apparatus body 1*a*.

Figure 3:
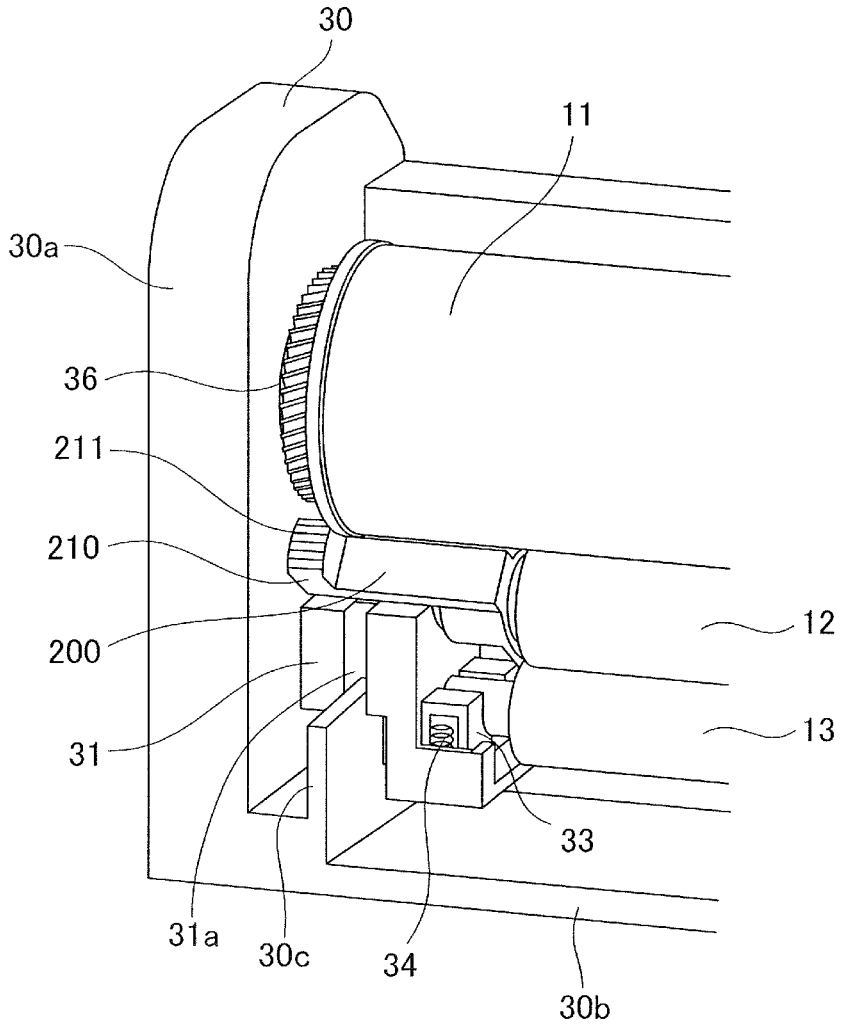
FIG. 3 is a partial perspective view of the drum unit according to the first exemplary embodiment which illustrates a contact state thereof and in which a regulation portion is omitted.

A gear 36 illustrated in FIGS. 3 and 4 serving as a rotary member fixed to integrally rotate with the photosensitive drum 11 about the rotation axis of the photosensitive drum 11 is provided on an end portion of the photosensitive drum 11 in the longitudinal direction, that is, in the rotation axis direction. That is, the gear 36 is provided on a rotation shaft of the photosensitive drum 11 so as to rotate together with the photosensitive drum 11. The gear 36 integrally rotates with the photosensitive drum 11 when a driving force is input to the photosensitive drum 11 via the coupling 39. The rotational force of the gear 36 is transmitted to the toner conveyance screw 38. As a result of this, the toner conveyance screw 38 rotates, and the transfer residual toner collected by the collection portion 15*b* is conveyed to the outside of the drum cartridge 100.

The charging roller 12 serving as a charging member is a roller-shaped member including a rotation shaft 12*a* that is a conductive support body such as a core metal or core material, and at least one elastic layer 12*b* formed around the rotation shaft 12*a*. The charging roller 12 is pressed to be in contact with the surface of the photosensitive drum 11 by a predetermined pressing force by a pressurizing spring 32 illustrated in FIG. 4 serving as an urging portion, and is rotationally driven in accordance with the rotation of the photosensitive drum 11.

More specific description will be given below. The rotation shaft 12*a* of the charging roller 12 is held by a charging roller bearing 31 serving as a roller holding portion, and thus the charging roller 12 is rotatably supported. In addition, the charging roller bearing 31 is slidably supported with respect to the drum container 30. Specifically, the charging roller bearing 31 is configured to be guided to be slidable in a direction toward the rotation axis of the photosensitive drum 11 by a slide guiding portion 30*c* provided in the drum container 30. In the illustrated example, a groove 31*a* is defined in the charging roller bearing 31 along the sliding direction thereof, and the slide guiding portion 30*c* engages with the groove 31*a* to guide the charging roller bearing 31 in the direction toward the rotation axis of the photosensitive drum 11.

Further, the charging roller 12 supported by the charging roller bearing 31 is configured to be movable in the direction toward the rotation axis of the photosensitive drum 11 along a plane perpendicular to the rotation axis of the photosensitive drum 11. As a result of this, the charging roller 12 is configured to be movable between a contact position where the charging roller 12 is in contact with the surface of the photosensitive drum 11 and a separation position where the charging roller 12 is separated from the surface of the photosensitive drum 11. Further, at the contact position, a voltage is applied to the charging roller 12, and thus the charging roller 12 charges the surface of the photosensitive drum 11.

Further, the pressurizing spring 32 serving as an urging portion is provided between the drum container 30 and the charging roller bearing 31. The pressurizing spring 32 urges the charging roller 12 in the direction toward the rotation axis of the photosensitive drum 11 along the plane perpendicular to the rotation axis of the photosensitive drum 11. This direction serves as an urging direction. That is, the pressurizing spring 32 urges the charging roller bearing 31 in the same direction as the sliding direction of the charging roller bearing 31. Therefore, the charging roller 12 is brought into pressure contact with the photosensitive drum 11. That is, the pressurizing spring 32 urges the charging roller 12 in a direction from the separation position toward the contact position.

The cleaning roller 13 serving as a cleaning member comes into contact with the charging roller 12 and cleans the surface of the charging roller 12. The cleaning roller 13 is a roller-shaped member including a rotation shaft 13*a* that is a rod-shaped supporting portion such as a core metal or a core material, and an elastic layer 13*b* formed around the rotation shaft 13*a*, and the outer peripheral surface of the cleaning roller 13 comes into contact with the charging roller 12. The cleaning roller 13 is pressed to be in contact with the surface of the charging roller 12 by a predetermined pressing force by a pressurizing spring 34 illustrated in FIGS. 3 and 4 serving as a cleaning member urging portion, and is rotationally driven in accordance with the rotation of the charging roller 12.

More specific description will be given below. The rotation shaft 13*a* of the cleaning roller 13 is supported by a cleaning roller bearing 33, and thus the cleaning roller 13 is rotatably supported. In addition, the cleaning roller bearing 33 is slidably supported with respect to the charging roller bearing 31. Specifically, the cleaning roller bearing 33 is configured to be slidable in a direction toward the rotation axis of the charging roller 12 such that the cleaning roller 13 can move in the direction toward the rotation axis of the charging roller 12 along a plane perpendicular to the rotation axis of the charging roller 12. To be noted, in the present exemplary embodiment, the rotation axis of the charging roller 12 coincides with a rotation axis of a separation member 200 that will be described later.

As a result of this, the cleaning roller 13 is provided to be movable between a roller contact position where the cleaning roller 13 is in contact with the surface of the charging roller 12 and a roller separation position where the cleaning roller 13 is separated from the surface of the charging roller 12. The cleaning roller 13 cleans the charging roller 12 at the roller contact position.

Further, a pressurizing spring 34 serving as a cleaning member urging portion is provided between the charging roller bearing 31 and the cleaning roller bearing 33. The pressurizing spring 34 urges the cleaning roller 13 in the direction toward the rotation axis of the charging roller 12 along the plane perpendicular to the rotation axis of the charging roller 12. This direction serves as an urging direction. Therefore, the cleaning roller 13 is brought into pressure contact with the charging roller 12. That is, the pressurizing spring 34 urges the cleaning roller 13 in a direction from the roller separation position toward the roller contact position. In other words, the cleaning roller 13 is supported by the cleaning roller bearing 33 to be movable along the urging force of the pressurizing spring 34. In addition, in the present exemplary embodiment, the urging direction of the pressurizing spring 32 approximately coincides with the urging direction of the pressurizing spring 34.

In addition, the cleaning roller 13 is supported by the charging roller bearing 31 via the cleaning roller bearing 33 and the pressurizing spring 34. Therefore, as will be described next, in the case where the charging roller 12 is moved in a direction away from the photosensitive drum 11 by the separation member 200, the cleaning roller 13 moves in the movement direction of the charging roller 12 in accordance with this.

In the configuration described above, when the photosensitive drum 11 rotates by receiving a driving force from a drive source such as a motor provided in the apparatus body 1*a*, the charging roller 12 is rotated by a frictional force from the photosensitive drum 11. Further, when the charging roller 12 rotates, the cleaning roller 13 is rotated by a frictional force from the charging roller 12. In addition, the toner conveyance screw 38 rotates by receiving a rotational driving force from the gear 36.

Separation Member

Next, the separation member 200 will be described with reference to FIGS. 3 to 7B. To be noted, in FIGS. 3 to 7B, a regulation portion 300 that will be described later is omitted. First, a separation holding configuration of holding the photosensitive drum 11, the charging roller 12, and the cleaning roller 13 in a state in which the charging roller 12 is separated from the photosensitive drum 11 and the cleaning roller 13 by using the separation member 200 will be described with reference to FIGS. 5, 6, and 7A.

Separation Holding Configuration

The drum cartridge 100 includes the separation member 200 for separating the charging roller 12 from the photosensitive drum 11 and the cleaning roller 13 to secure a clearance between the charging roller 12 and the photosensitive drum 11 and a clearance between the charging roller 12 and the cleaning roller 13 while the drum cartridge 100 is transported for distribution.

The separation member 200 is swingably provided on the rotation shaft 12*a* of the charging roller 12. In the present exemplary embodiment, the separation member 200 is provided on each end of the rotation shaft 12*a* of the charging roller 12 to be swingable with respect to the rotation shaft 12*a* as a swing shaft. In other words, the separation member 200 is supported by the charging roller 12 to be swingable about the rotation axis of the charging roller 12. Therefore, the separation member 200 is movable in coordination with movement of the charging roller 12. To be noted, since the configurations of the separation members 200 on both ends of the charging roller 12 are substantially the same, description will be given below with reference to drawings illustrating only one of the separation members 200.

The separation member 200 includes two separation holding portions 210 and 220 and a swing supporting portion 230. The swing supporting portion 230 is swingably fit on the rotation shaft 12*a* of the charging roller 12 as described above. As a result of this, the separation member 200 is swingably supported with respect to the rotation shaft 12*a*. The separation holding portion 210 is disposed between the gear 36 provided on the photosensitive drum 11 and the rotation shaft 12*a* of the charging roller 12, separates the photosensitive drum 11 and the charging roller 12 from each other, and secures a clearance therebetween. The separation holding portion 220 is disposed between the rotation shaft 12*a* of the charging roller 12 and the rotation shaft 13*a* of the cleaning roller 13, separates the charging roller 12 and the cleaning roller 13 from each other, and secures a clearance therebetween.

In addition, the two separation holding portions 210 and 220 and the swing supporting portion 230 are integrally formed. Therefore, in a state in which the separation member 200 is positioned at a first phase in the swing direction, the photosensitive drum 11, the charging roller 12, and the cleaning roller 13 are held in a state in which the charging roller 12 is separated from the photosensitive drum 11 and the cleaning roller 13 respectively by the separation holding portions 210 and 220. This state will be also referred to as a separation holding state. Meanwhile, in the case where the separation member 200 has swung to a second phase from the first phase in the swing direction, the separation holding state of the photosensitive drum 11 and the charging roller 12 and the separation holding state of the charging roller 12 and the cleaning roller 13 are simultaneously cancelled as will be described later. This state will be also referred to as a separation cancellation state.

The separation holding portion 210 is sandwiched between the rotation shaft 12*a* of the charging roller 12, that is, the rotation shaft of the separation member 200, and the gear 36 by the pressing force, that is, the urging force of the pressurizing spring 32 in the separation holding state of the photosensitive drum 11 and the charging roller 12. In addition, the separation holding portion 220 is sandwiched between the rotation shaft 13*a* of the cleaning roller 13 and the rotation shaft 12*a* of the charging roller 12 by the pressing force, that is, the urging force of the pressurizing spring 34 in the separation holding state of the charging roller 12 and the cleaning roller 13.

Figure 7A:
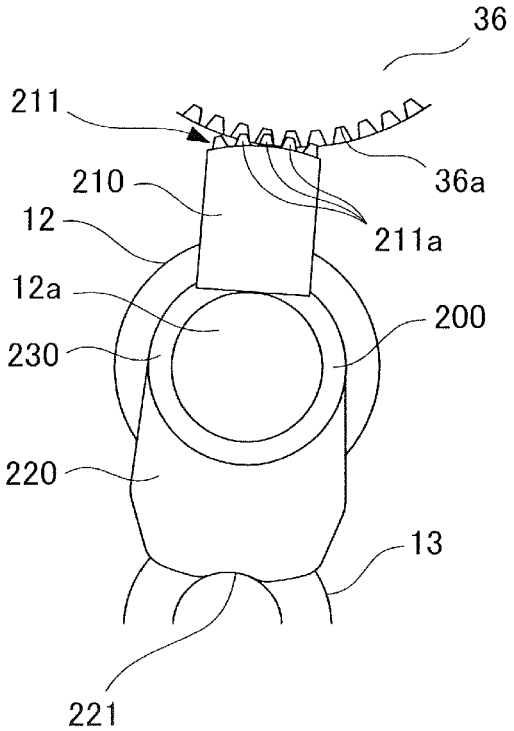
FIG. 7A is a schematic section view of the separation member according to the first exemplary embodiment illustrating the separation state thereof.

In addition, as illustrated in FIG. 7A, the separation holding portion 210 of the separation member 200 includes an engagement portion 211 capable of engaging with the gear 36. The engagement portion 211 includes gear teeth 211*a* serving as projection portions formed on a side surface of the separation holding portion 210 opposing the gear 36 in the separation holding state. In addition, engagement recess portions 36*a* serving as recess portions capable of engaging with the gear teeth 211*a* are defined on the entire outer peripheral surface of the gear 36. That is, gaps between gear teeth of the gear 36 are regarded as the engagement recess portions 36*a*. The gear teeth 211*a* are formed at the same pitch as the pitch of the engagement recess portions 36*a* of the gear 36, that is, the pitch of the gear teeth of the gear 36. In the separation holding state in which the photosensitive drum 11 and the charging roller 12 are separated from each other, the gear teeth 211*a* of the engagement portion 211 are engaged with the engagement recess portions 36*a* of the gear 36. The separation member 200 holds the charging roller 12 against the urging force of the pressurizing spring 32 at the separation position where the charging roller 12 is separated from the photosensitive drum 11 in a state in which the engagement portion 211 is engaged with the gear 36 serving as a rotary member.

In addition, the separation holding portion 220 of the separation member 200 includes an engagement portion 221 serving as a cleaning member engagement portion capable of engaging with the rotation shaft 13*a* of the cleaning roller 13 serving as a part of a cleaning member. The engagement portion 221 is a recess portion provided on a side surface of the separation holding portion 220 that opposes the rotation shaft 13*a* in the separation holding state and having a curvature radius approximately equal to the outer diameter of the outer peripheral surface of the rotation shaft 13*a* having a cylindrical shape. In addition, the engagement portion 221 is engaged with the rotation shaft 13*a* in the separation holding state in which the charging roller 12 and the cleaning roller 13 are separated from each other. In other words, at this time, the separation member 200 holds the cleaning roller 13 at the separation position where the charging roller 12 and the cleaning roller 13 are separated from each other against the urging force of the pressurizing spring 34 in a state in which the engagement portion 221 is engaged with the rotation shaft 13*a* serving as a part of a cleaning member.

The engagement portion 221 of the separation holding portion 220 is formed to be engaged with the rotation shaft 13*a* of the cleaning roller 13 in a state in which the engagement portion 211 of the separation holding portion 210 is engaged with the gear 36. Therefore, in the state in which the separation member 200 is positioned at the first phase in the swing direction, the engagement portion 211 is engaged with the gear 36 and the engagement portion 221 is engaged with the rotation shaft 13*a*. Thus, the charging roller 12 and the cleaning roller 13 are held in a state of being separated from each other. As a result of this, the elastic layer 12*b* of the charging roller 12 is separated from the photosensitive drum 11, the charging roller 12 is separated from the cleaning roller 13, and a clearance therebetween is secured, for example, when transporting the drum cartridge 100.

Configuration of Separation Cancellation

Figure 7B:
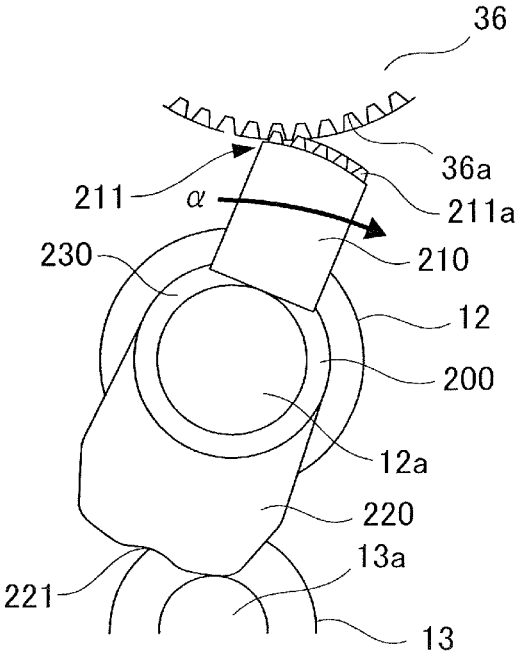
FIG. 7B is a schematic section view of the separation member according to the first exemplary embodiment illustrating a state in which the separation state thereof is cancelled.

Next, a configuration of separation cancellation in which the separation holding state of the photosensitive drum 11 and the charging roller 12 and the separation holding state of the charging roller 12 and the cleaning roller 13 are cancelled by the separation member 200 will be described with reference to FIGS. 3, 4, and 7B. When a brand-new drum cartridge 100 is attached to the apparatus body 1*a* illustrated in FIG. 1 and the image forming apparatus 1 illustrated in FIG. 1 is booted up, a rotational driving force is input to the photosensitive drum 11 from a motor provided in the apparatus body 1*a* in a starting operation performed by the image forming apparatus 1.

When the drum cartridge 100 is attached to the apparatus body 1*a*, the drum cartridge 100 is in the separation holding state in which the charging roller 12 is separated from the photosensitive drum 11 and the cleaning roller 13 as illustrated in FIG. 7A. When the rotation of the photosensitive drum 11 is started in this separation holding state, the gear 36 rotates together with the rotation of the photosensitive drum 11 as illustrated in FIG. 7B. Then, the engagement portion 211 engaged with the gear 36 receives the rotational force of the gear 36, and the separation member 200 swings in a predetermined direction $\alpha$ indicated by an arrow in FIG. 7B.

As a result of the separation member 200 swinging in this manner, the engagement between the engagement portion 211 and the gear 36 is released, and the separation holding portion 210 is released from a state of being sandwiched between the rotation shaft 12*a* of the charging roller 12, that is, the swing shaft of the separation member 200, and the gear 36. As a result of this, the state in which the charging roller 12 is held at the separation position is automatically cancelled.

In addition, as a result of the separation member 200 swinging, the engagement between the engagement portion 221 and the rotation shaft 13*a* of the cleaning roller 13 is released, and the separation holding portion 220 is released from the state of being sandwiched between the rotation shaft 12*a* of the charging roller 12 and the rotation shaft 13*a* of the cleaning roller 13. As a result of this, the state in which the cleaning roller 13 is held at the roller separation position is automatically cancelled. That is, in the present exemplary embodiment, when the gear 36 rotates in the starting operation of the image forming apparatus 1 after the drum cartridge 100 is attached to the apparatus body 1*a*, the separation member 200 swings and the separation holding states of the charging roller 12 and the cleaning roller 13 are automatically cancelled at the same time.

Regulation of Movement of Separation Member

Next, a configuration capable of suppressing unintentional release of the engagement between the engagement portion 211 of the separation member 200 and the gear 36 even in the case where a strong vibration is applied to the drum cartridge 100 while, for example, the drum cartridge 100 is being transported will be described with reference to FIGS. 8 to 11B. In the present exemplary embodiment, unintentional release of the engagement between the engagement portion 211 of the separation member 200 and the gear 36 is suppressed by a regulation portion 300. That is, the regulation portion 300 regulates movement of the separation member 200 in a direction to increase the distance between the swing center of the separation member 200 and the rotation center of the gear 36 in the state in which the engagement portion 211 and the gear 36 are engaged with each other, such that the engagement between the engagement portion 211 and the gear 36 is not released.

Figure 8:
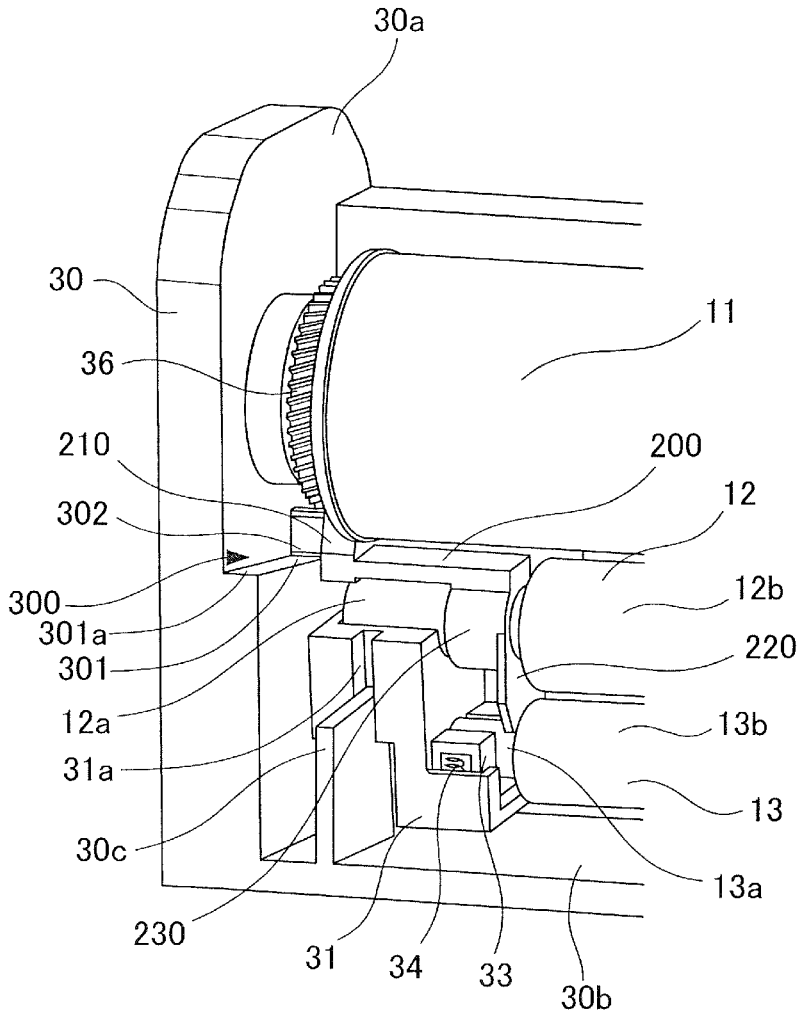
FIG. 8 is a partial perspective view of the drum unit according to the first exemplary embodiment illustrating the separation state thereof.
Figure 9A:
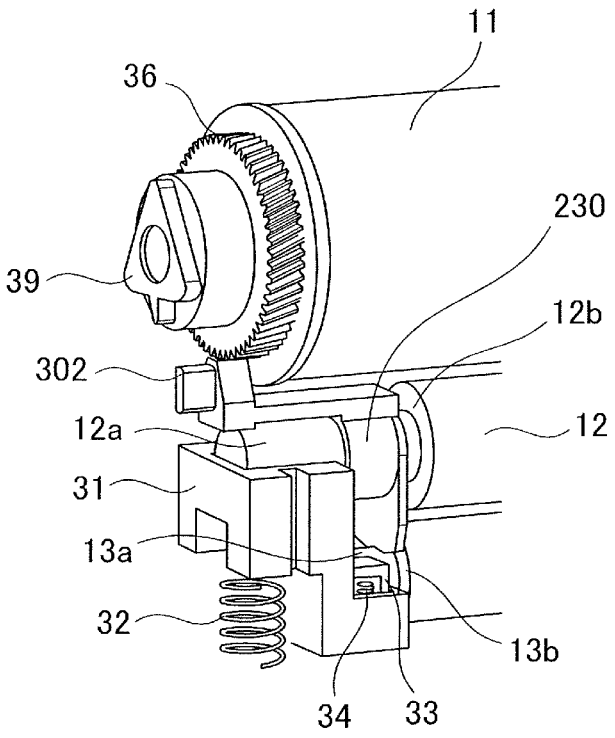
FIG. 9A is a partial perspective view of the drum unit according to the first exemplary embodiment which illustrates the separation state thereof and in which the frame is omitted.

In the present exemplary embodiment, the regulation portion 300 includes an abutting portion 302 provided on the separation member 200 and an abutted portion 301 provided in the drum container 30 as illustrated in FIG. 8. As illustrated in FIG. 9A, the abutting portion 302 is provided to project in the rotation axis direction of the photosensitive drum 11 from an end surface of the separation holding portion 210. Therefore, the abutting portion 302 is provided further on the outside than the photosensitive drum 11 in the rotation axis direction.

Figure 9B:
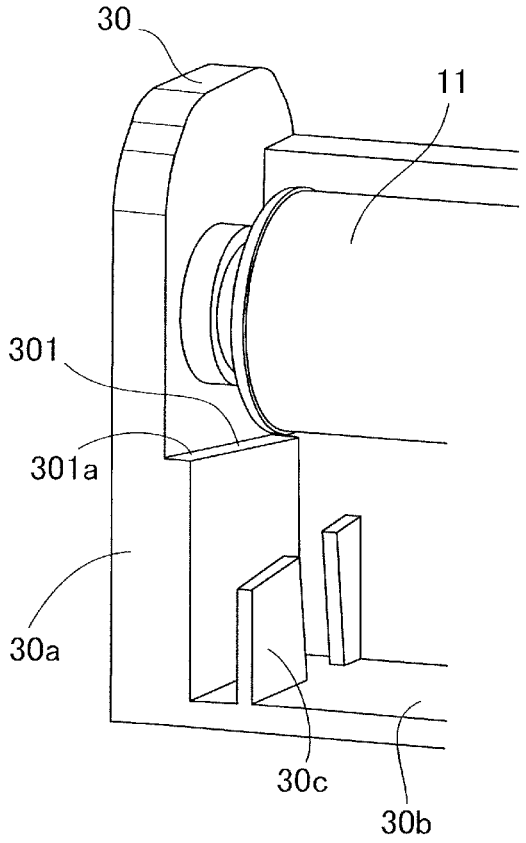
FIG. 9B is a partial perspective view of a photosensitive drum and the frame of the drum unit according to the first exemplary embodiment.

As illustrated in FIG. 9B, the abutted portion 301 is provided on a side wall 30*a* of the drum container 30 opposing an end portion of the photosensitive drum 11 in the rotation axis direction. Specifically, the abutted portion 301 is formed by causing, in a side surface of the side wall 30*a*, a portion further on the charging roller 12 side than a portion opposing the end portion of the photosensitive drum 11 in the rotation axis direction to project to the inside in the rotation axis direction, that is, toward the charging roller 12 side. The abutted portion 301 having such a structure is formed such that the abutting portion 302 abuts the abutted portion 301 in the case where the separation member 200 moves in the direction to increase the distance between the swing center of the separation member 200 and the rotation center of the gear 36 in the state in which the engagement portion 211 is engaged with the gear 36.

That is, the abutted portion 301 includes an abutted surface 301*a* that the abutting portion 302 abuts. The abutted surface 301*a* is formed on the side toward which the separation member 200 moves to increase the distance between the swing center of the separation member 200 and the rotation center of the gear 36 with respect to the abutting portion 302 in the state in which the separation member 200 is in the separation holding state. Here, the separation member 200 is provided to be swingable with respect to the rotation shaft 12*a* of the charging roller 12, and the swing center of the separation member 200 approximately coincides with the rotation center of the charging roller 12. In addition, the charging roller 12 is urged toward the photosensitive drum 11 by the pressurizing spring 32, and the separation holding portion 210 of the separation member 200 is nipped between the rotation shaft 12*a* of the charging roller 12 and the gear 36 by the urging force of the pressurizing spring 32.

Therefore, in the present exemplary embodiment, the direction in which the separation member 200 moves to increase the distance between the swing center of the separation member 200, that is, the rotation center of the charging roller 12, and the rotation center of the gear 36, that is, the rotation center of the photosensitive drum 11, is opposite to the urging direction of the pressurizing spring 32. Therefore, the abutted surface 301*a* is positioned in a direction opposite to the urging direction of the pressurizing spring 32 with respect to the abutting portion 302 when the separation member 200 is in the separation holding state. Therefore, as a result of the abutting portion 302 abutting the abutted surface 301*a*, the movement of the separation member 200 in a direction away from the gear 36 against the urging force of the pressurizing spring 32 is regulated.

Figure 10B:
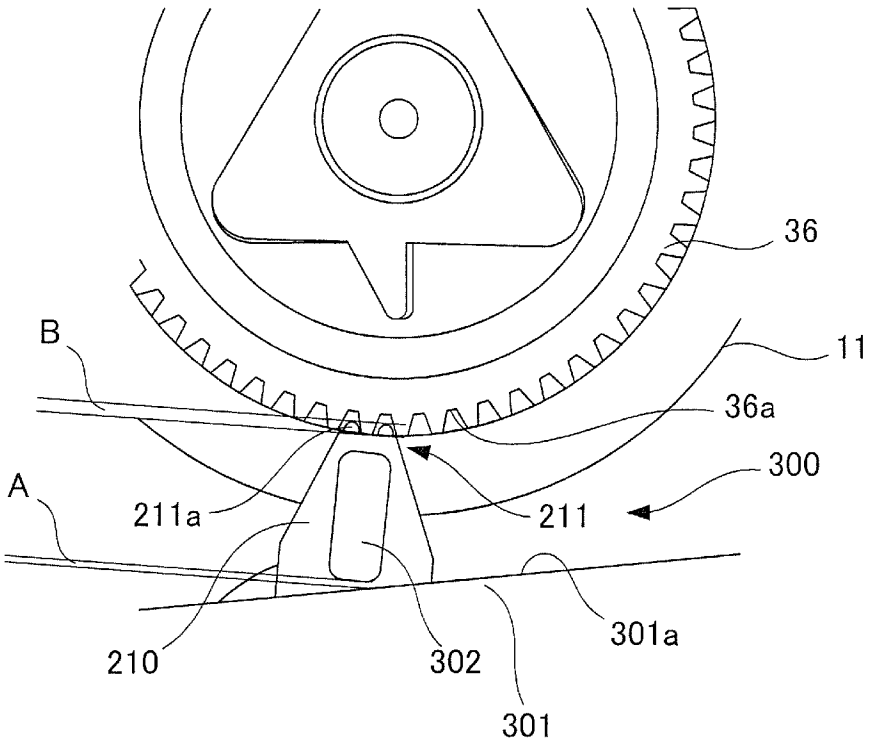
FIG. 10B is a section view of the drum unit according to the first exemplary embodiment taken along a line X-X of FIG. 10A.
Figure 10A:
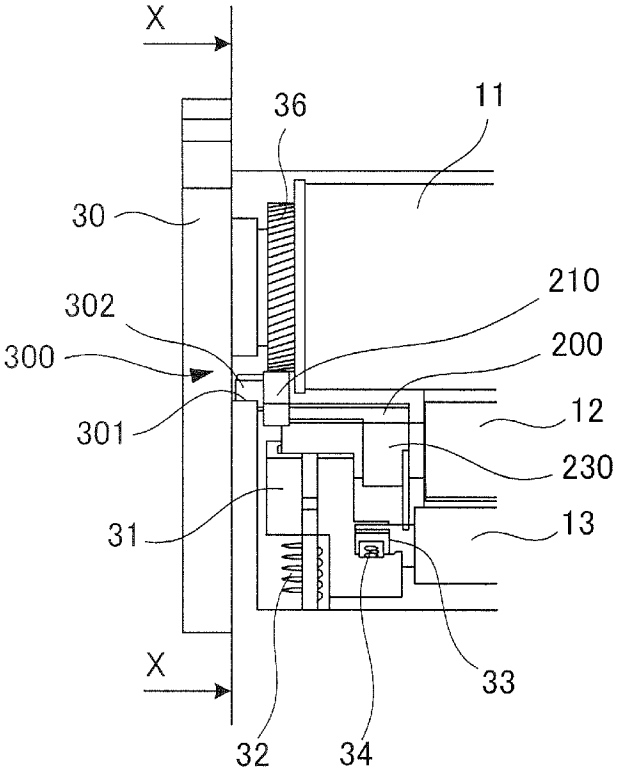
FIG. 10A is a partial side view of the drum unit according to the first exemplary embodiment illustrating the separation state thereof.

Here, as illustrated in FIGS. 10A and 10B, the distance between the abutting portion 302 and the abutted portion 301 in a state in which the separation holding state is taken and the separation member 200 has not moved in the direction to increase the distance between the swing center of the separation member 200 and the rotation center of the gear 36 is denoted by A. The distance A is preferably larger than 0. That is, a gap is preferably present between the abutting portion 302 and the abutted portion 301 in this state. To be noted, the separation holding state is a state in which the separation member 200 is holding the charging roller 12 at the separation position. In addition, the state in which the separation member 200 has not moved in the direction to increase the distance between the swing center of the separation member 200 and the rotation center of the gear 36 is a state in which the separation holding portion 210 of the separation member 200 is pressed against the gear 36 and is not separated from the gear 36. In this state, the distance A is smaller than a length of overlap between a gear tooth 211*a* and an engagement recess portion 36*a* in a projecting direction of the gear tooth 211*a* as viewed in the rotation direction of the gear 36, that is, smaller than the amount of engagement between the gear tooth 211*a* and the engagement recess portion 36*a*. The length of overlap will be also referred to as an engagement amount B.

That is, as illustrated in FIGS. 10A and 10B, in the relationship between the distance A between the abutting portion 302 and the abutted surface 301*a* and the engagement amount B between the gear 36 and the engagement portion 211 in the separation holding state, the distance A is smaller than the engagement amount B in the sliding direction of the charging roller bearing 31. That is, $A<B$ holds. This configuration regulates the movement of the separation member 200 in the direction to increase the distance between the swing center of the separation member 200 and the rotation center of the gear 36 in the state in which the engagement portion 211 is engaged with the gear 36, such that the engagement between the engagement portion 211 and the gear 36 is not released.

For example, there is a risk that the charging roller 12 moves in a direction away from the photosensitive drum 11 against the urging force of the pressurizing spring 32 by being vibrated or dropped while the drum cartridge 100 is transported. In this case, the separation member 200 supported on the rotation shaft of the charging roller 12 also moves in the direction away from the photosensitive drum 11. However, since the distance A is smaller than the engagement amount B as described above, the abutting portion 302 abuts the abutted portion 301 before the engagement between the engagement portion 211 and the gear 36 is released, thus the movement of the separation member 200 is regulated, and the cancellation of the separation holding state is suppressed.

To be noted, when the separation holding state is cancelled, the gear 36 rotates together with the photosensitive drum 11 and the separation member 200 swings, and the engagement between the engagement portion 211 and the gear 36 is released. At this time, the separation member 200 is urged toward the photosensitive drum 11 together with the charging roller 12 by the pressurizing spring 32, and therefore moves toward the photosensitive drum 11 in accordance with the release of engagement between the engagement portion 211 and the gear 36. In other words, the abutting portion 302 provided on the separation member 200 moves in a direction away from the abutted portion 301 while the separation member 200 is swinging. Therefore, the separation member 200 swings to cancel the separation holding state without interference between the abutting portion 302 and the abutted portion 301.

In addition, in the present exemplary embodiment, rotation of the separation member 200 from the position at which the separation member 200 is in the separation holding state in a direction opposite to such a rotation direction that the separation holding state is automatically cancelled, that is, in a direction opposite to the predetermined direction α is regulated in the state in which the abutting portion 302 is abutting the abutted portion 301. Therefore, as illustrated in FIG. 11A, the abutted portion 301 is formed such that a reaction force P in the normal direction applied to the abutting portion 302 when the abutting portion 302 abuts the abutted portion 301 acts in a direction to swing the separation member 200 in the direction opposite to the predetermined direction α.

Figure 11B:
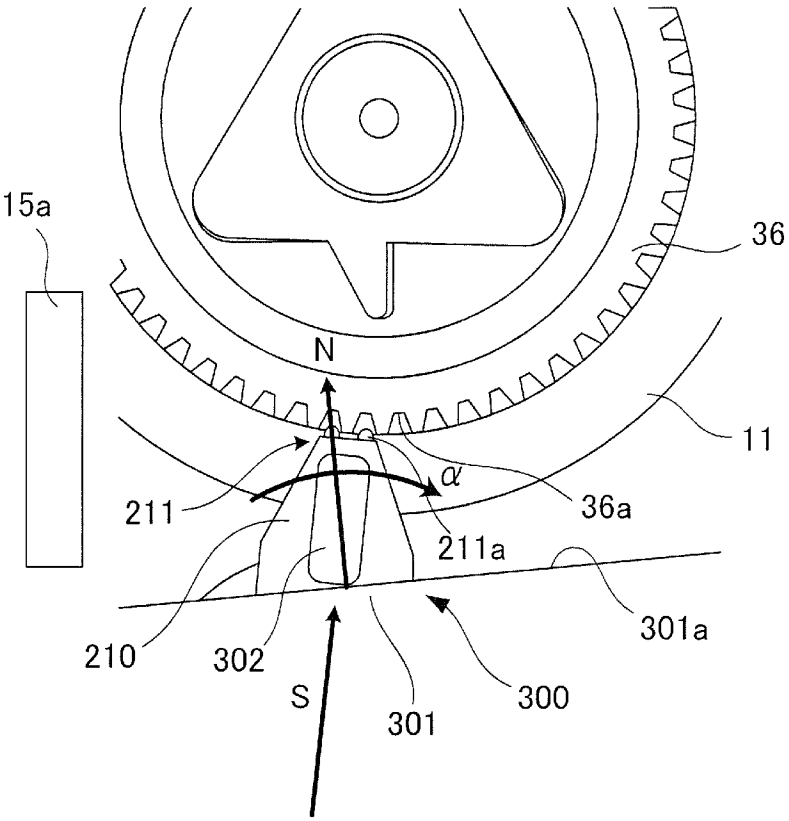
FIG. 11B is a diagram similar to FIG. 10B illustrating a relationship between an urging direction in which an urging force is applied to the separation member when the abutting portion abuts the abutted portion in the first exemplary embodiment and a normal vector at the abutting portion.
Figure 11A:
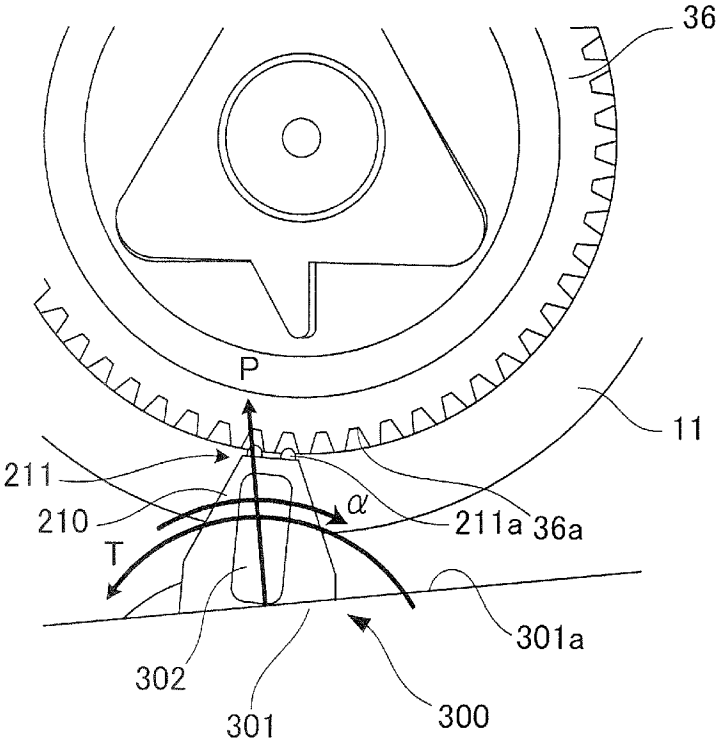
FIG. 11A is a diagram similar to FIG. 10B illustrating a direction of a torque acting when an abutting portion abuts an abutted portion in the first exemplary embodiment.

In the present exemplary embodiment, as illustrated in FIG. 11B, the abutted surface 301*a* of the abutted portion 301 is inclined in the direction opposite to the predetermined direction α with respect to a direction perpendicular to an urging direction S of the pressurizing spring 32 illustrated in FIG. 9A and so forth. In other words, the abutted surface 301*a* is made up of a surface inclined with respect to the sliding direction of the charging roller bearing 31, which is the same direction as the urging direction S.

Specific description will be given below. The abutted surface 301*a* is formed as such an inclined surface that the reaction force P in the normal direction applied to the abutting portion 302 when the abutting portion 302 abuts the abutted surface 301*a* includes a force component that rotates the separation member 200 in the direction opposite to the direction in which the separation member 200 rotates at the time of automatic cancellation, that is, in the direction opposite to the predetermined direction α. In other words, as illustrated in FIG. 11A, the reaction force P in the normal direction generates a torque T that rotates the separation member 200 in the direction opposite to the predetermined direction α.

In the present exemplary embodiment, as illustrated in FIG. 11B, the normal direction N of the abutted surface 301*a* is more toward the cleaning blade 15*a* side than a direction toward the rotation axis of the photosensitive drum 11, that is, than the urging direction S, in the sliding direction of the charging roller bearing 31. As illustrated in FIG. 2, the cleaning blade 15*a* abuts the photosensitive drum 11 in a counter direction with respect to the rotation direction of the photosensitive drum 11. In addition, the cleaning blade 15*a* is provided upstream of the charging roller 12 in the rotation direction of the photosensitive drum 11 to clean the surface of the photosensitive drum 11 before charging the photosensitive drum 11. The separation member 200 swings in the predetermined direction α as a result of the photosensitive drum 11 rotating in the rotation direction β. Therefore, the cleaning blade 15*a* is positioned in a direction opposite to the predetermined direction α from the separation member 200. Therefore, in the present exemplary embodiment, the normal direction N of the abutted surface 301*a* is more toward the cleaning blade 15*a* side than the urging direction S.

In the case where a big impact is applied to the drum cartridge 100 while the drum cartridge 100 is transported or the like, the following problem may arise. That is, there is a possibility that the relationship between the distance A between the abutting portion 302 and the abutted surface 301*a* and the engagement amount B between the gear 36 and the engagement portion 211 in the separation holding state is reversed from the state described above as a result of deformation of the drum container 30 or the like. That is, there is a possibility that the relationship changes to A>B.

However, by forming the abutted surface 301*a* in an inclined shape as described above, unintended cancellation of the separation holding state can be suppressed even in the case where, for example, the relationship changes to A>B and the gear 36 and the engagement portion 211 are temporarily separated from each other. That is, when the separation member 200 is moved by the impact and the abutting portion 302 abuts the abutted surface 301*a*, the reaction force P in the normal direction that rotates the separation member 200 in the direction opposite to the direction in which the separation member 200 rotates at the time of automatic cancellation, that is, in the direction opposite to the predetermined direction α, is generated in the abutting portion 302. Therefore, rotation of the separation member 200 in the predetermined direction α is suppressed, and cancellation of the separation holding state can be suppressed even when A>B holds.

As described above, even in the case where a vibration or an impact is applied to the drum cartridge 100 and the separation member 200 has moved in the direction away from the gear 36, the movement of the separation member 200 is regulated, and release of engagement between the engagement portion 211 and the gear 36 can be suppressed. As a result of this, occurrence of unintended cancellation of the separation holding state of the photosensitive drum 11 and the charging roller 12 and further occurrence of unintended cancellation of the separation holding state of the charging roller 12 and the cleaning roller 13 can be reduced.

Second Exemplary Embodiment

A second exemplary embodiment will be described with reference to FIGS. 12 to 16B. Whereas the first exemplary embodiment described above is a configuration including the cleaning roller 13, the present exemplary embodiment is a configuration not including the cleaning roller 13. In addition, in the present exemplary embodiment, the position of a regulation portion 300A that regulates the movement of a separation member 200A is different from that of the first exemplary embodiment. The other elements and effects are the same as in the first exemplary embodiment described above, and therefore the same elements are denoted by the same reference signs and description thereof will be omitted or simplified. Elements different from the first exemplary embodiment will be mainly described below.

Figure 12:
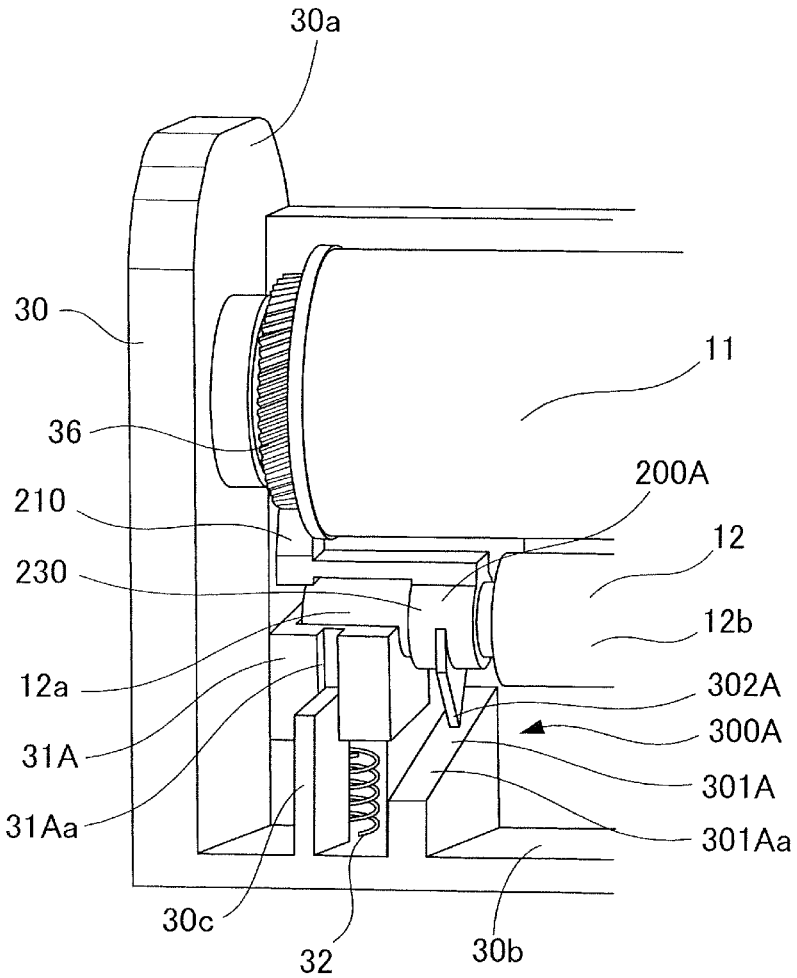
FIG. 12 is a partial perspective view of a drum unit according to a second exemplary embodiment illustrating a separation state thereof.

As illustrated in FIG. 12, the rotation shaft 12*a* of the charging roller 12 is held by a charging roller bearing 31A serving as a roller holding portion, and thus the charging roller 12 is rotatably supported. In addition, the charging roller bearing 31A is slidably supported with respect to the drum container 30 similarly to the first exemplary embodiment. Specifically, the charging roller bearing 31A is configured to be guided to be slidable in a direction toward the rotation axis of the photosensitive drum 11 by the slide guiding portion 30*c* provided in the drum container 30. In the illustrated example, a groove 31Aa is defined in the charging roller bearing 31A along the sliding direction thereof, and the slide guiding portion 30*c* engages with the groove 31Aa to guide the charging roller bearing 31A in the direction toward the rotation axis of the photosensitive drum 11.

In addition, similarly to the first exemplary embodiment, the pressurizing spring 32 serving as an urging portion is provided between the drum container 30 and the charging roller bearing 31A. The pressurizing spring 32 urges the charging roller 12 in the direction toward the rotation axis of the photosensitive drum 11 along the plane perpendicular to the rotation axis of the photosensitive drum 11. This direction serves as an urging direction.

To be noted, since the cleaning roller 13 is not provided in the present exemplary embodiment unlike the first exemplary embodiment, the configuration of the charging roller bearing 31A is different from the configuration of the charging roller bearing 31 of the first exemplary embodiment in this point.

In the configuration described above, when the photosensitive drum 11 rotates by receiving a driving force from a drive source such as a motor provided in the apparatus body 1*a* illustrated in FIG. 1, the charging roller 12 is rotated by a frictional force from the photosensitive drum 11. In addition, the toner conveyance screw 38 rotates by receiving a rotational driving force from the gear 36.

Separation Member

Next, the separation member 200A of the present exemplary embodiment will be described. In the present exemplary embodiment, the cleaning roller 13 is not provided unlike the first exemplary embodiment. Therefore, the separation member 200A does not include the separation holding portion 220 unlike the first exemplary embodiment, and includes the one separation holding portion 210 and the swing supporting portion 230. The swing supporting portion 230 is swingably fit on the rotation shaft 12*a* of the charging roller 12. The separation holding portion 210 is disposed between the gear 36 provided on the photosensitive drum 11 and the rotation shaft 12*a* of the charging roller 12, separates the photosensitive drum 11 and the charging roller 12 from each other, and secures a clearance therebetween. The configurations and effects of the swing supporting portion 230 and the separation holding portion 210 are the same as in the first exemplary embodiment.

Figure 14B:
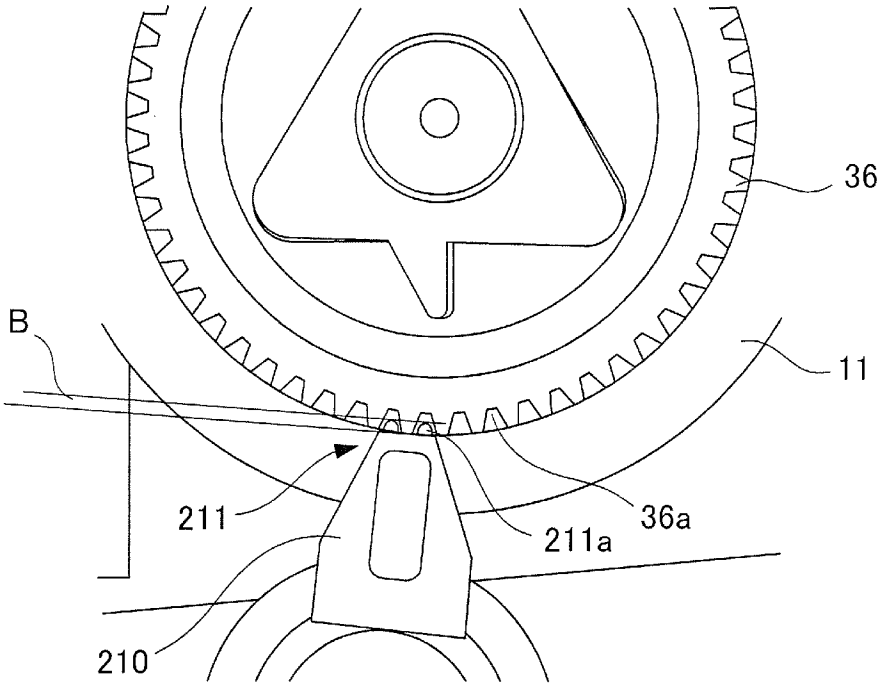
FIG. 14B is a section view of the drum unit according to the second exemplary embodiment taken along a line Y-Y of FIG. 14A.

Therefore, as illustrated in FIG. 14B, the separation holding portion 210 includes the engagement portion 211 capable of engaging with the gear 36. When a rotational driving force is input to the photosensitive drum 11 from a motor provided in the apparatus body 1*a*, the engagement portion 211 engaged with the gear 36 receives the rotational force of the gear 36, and thus the separation member 200A swings in the predetermined direction α, which is indicated by an arrow in FIGS. 16A and 16B. As a result of the separation member 200A swinging in this manner, the engagement between the engagement portion 211 and the gear 36 is released, and the separation holding portion 210 is released from a state of being sandwiched between the rotation shaft 12*a* of the charging roller 12, that is, the swing shaft of the separation member 200A, and the gear 36. As a result of this, the state in which the charging roller 12 is held at the separation position is automatically cancelled.

Regulation of Movement of Separation Member

Next, a configuration capable of suppressing unintentional release of the engagement between the engagement portion 211 of the separation member 200A and the gear 36 will be described. Also, in the present exemplary embodiment, unintentional release of the engagement between the engagement portion 211 of the separation member 200A and the gear 36 is suppressed by a regulation portion 300A. That is, the regulation portion 300A regulates movement of the separation member 200A in a direction to increase the distance between the swing center of the separation member 200A and the rotation center of the gear 36 in the state in which the engagement portion 211 and the gear 36 are engaged with each other, such that the engagement between the engagement portion 211 and the gear 36 is not released.

In the present exemplary embodiment, the regulation portion 300A includes an abutting portion 302A provided on the separation member 200A and an abutted portion 301A provided in the drum container 30 as illustrated in FIG. 12. As illustrated in FIG. 13A, the abutting portion 302A is provided to project in a direction opposite to the photosensitive drum 11 from an outer peripheral surface of the swing supporting portion 230. Therefore, the abutting portion 302A is provided further on the inside than the charging roller bearing 31A in the rotation axis direction of the charging roller 12.

Figure 13B:
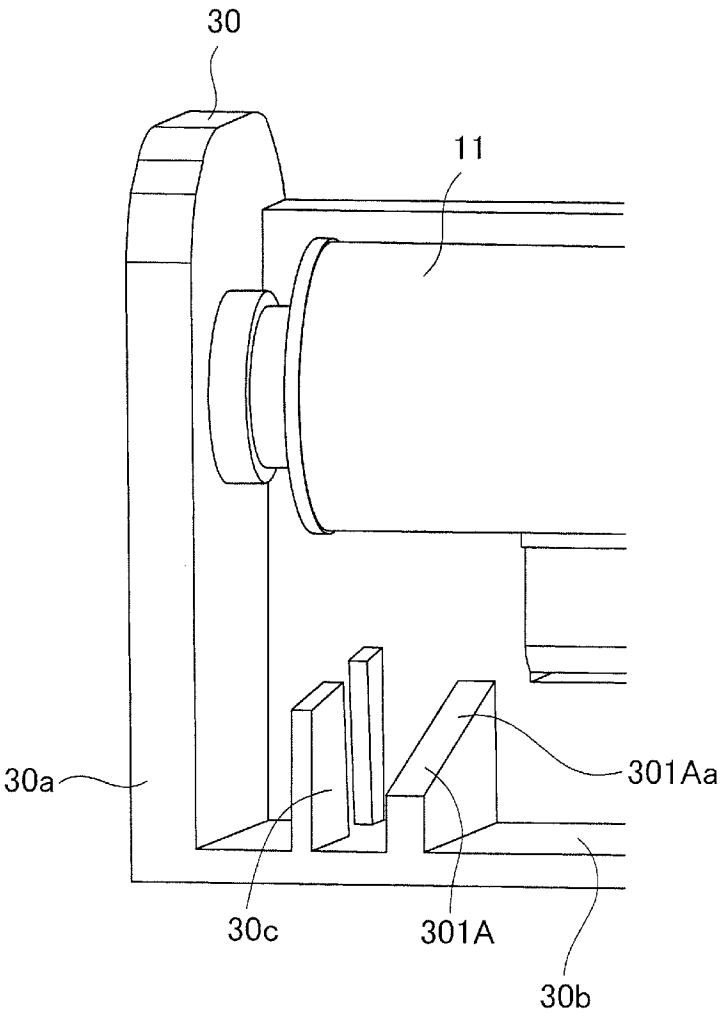
FIG. 13B is a partial perspective view of a photosensitive drum and the frame of the drum unit according to the second exemplary embodiment.
Figure 13A:
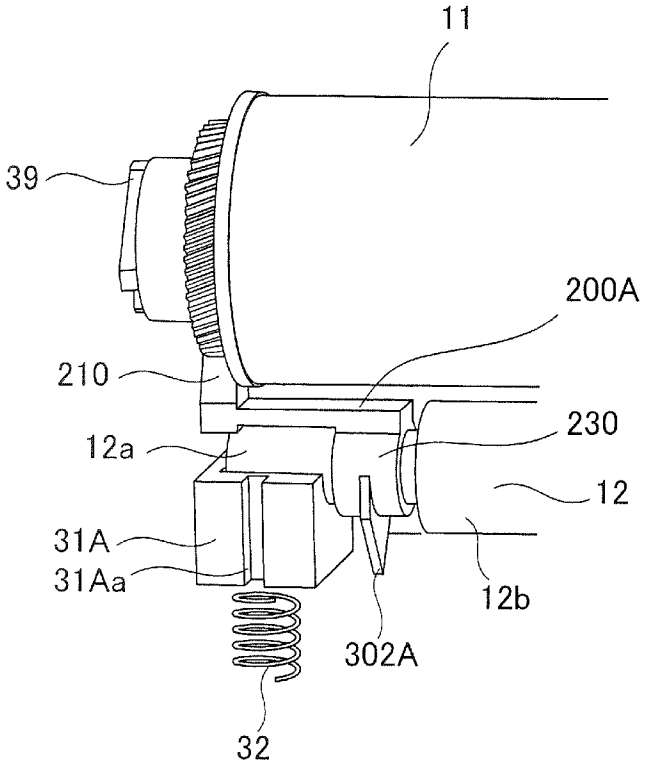
FIG. 13A is a partial perspective view of the drum unit according to the second exemplary embodiment which illustrates the separation state thereof and in which a frame is omitted.

As illustrated in FIG. 13B, the abutted portion 301A is provided on the connecting portion 30*b* interconnecting side walls 30*a* at both end portions of the drum container 30 in the rotation axis direction of the photosensitive drum 11. Specifically, the abutted portion 301A is formed by causing a part of the connecting portion 30*b* to project toward the charging roller 12 side. The abutted portion 301A having such a structure is formed such that the abutting portion 302A abuts the abutted portion 301A in the case where the separation member 200A moves in the direction to increase the distance between the swing center of the separation member 200A and the rotation center of the gear 36 in the state in which the engagement portion 211 is engaged with the gear 36.

That is, the abutted portion 301A includes an abutted surface 301Aa that the abutting portion 302A abuts. The abutted surface 301Aa is formed on the side toward which the separation member 200A moves to increase the distance between the swing center of the separation member 200A and the rotation center of the gear 36 with respect to the abutting portion 302A in the state in which the separation member 200A is in the separation holding state. To be noted, also in the present exemplary embodiment, the direction in which the separation member 200A moves to increase the distance between the swing center of the separation member 200A, that is, the rotation center of the charging roller 12, and the rotation center of the gear 36, that is, the rotation center of the photosensitive drum 11, is opposite to the urging direction of the pressurizing spring 32.

Therefore, the abutted surface 301Aa is positioned in a direction opposite to the urging direction of the pressurizing spring 32 with respect to the abutting portion 302A when the separation member 200A is in the separation holding state. Therefore, as a result of the abutting portion 302A abutting the abutted surface 301Aa, the movement of the separation member 200A in a direction away from the gear 36 against the urging force of the pressurizing spring 32 is regulated.

Figure 14A:
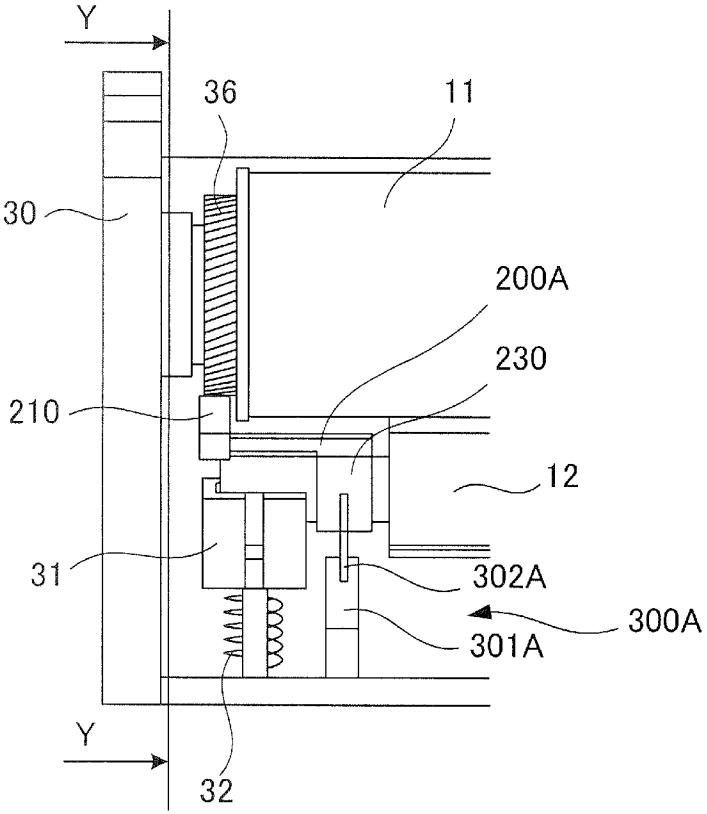
FIG. 14A is a partial side view of the drum unit according to the second exemplary embodiment illustrating the separation state thereof.
Figure 15B:
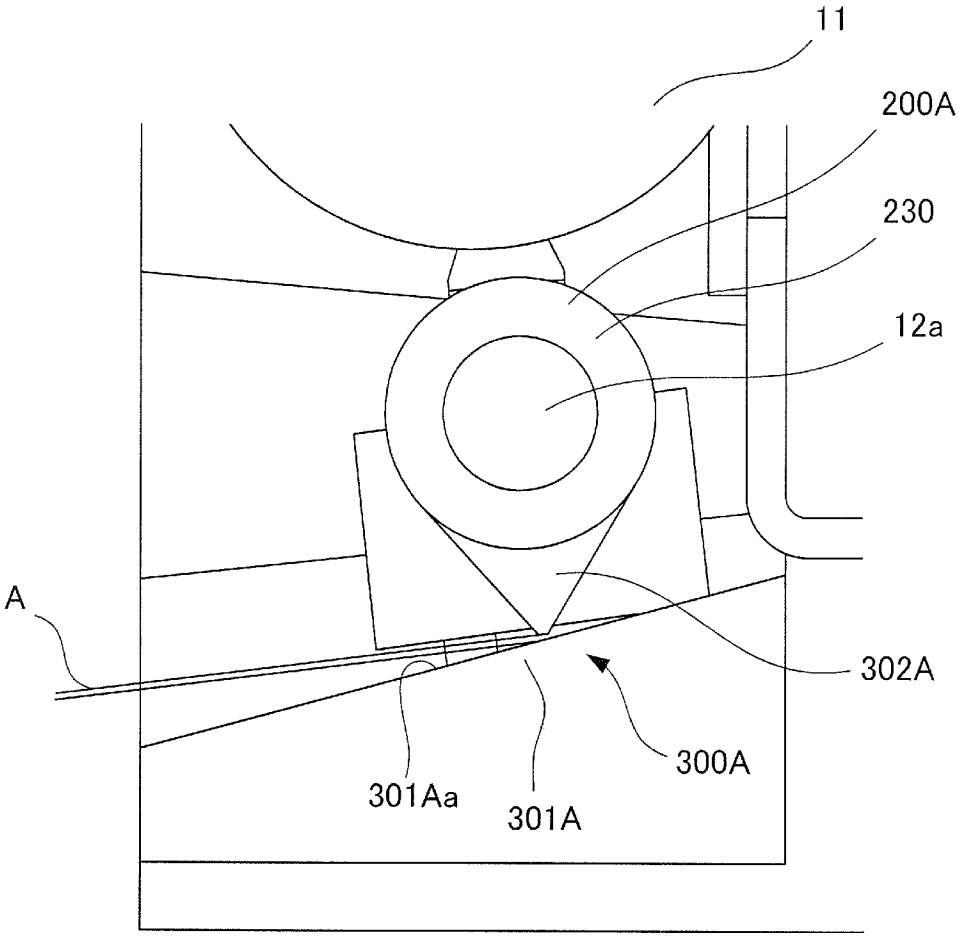
FIG. 15B is a section view of the drum unit according to the second exemplary embodiment taken along a line Z-Z of FIG. 15A.
Figure 15A:
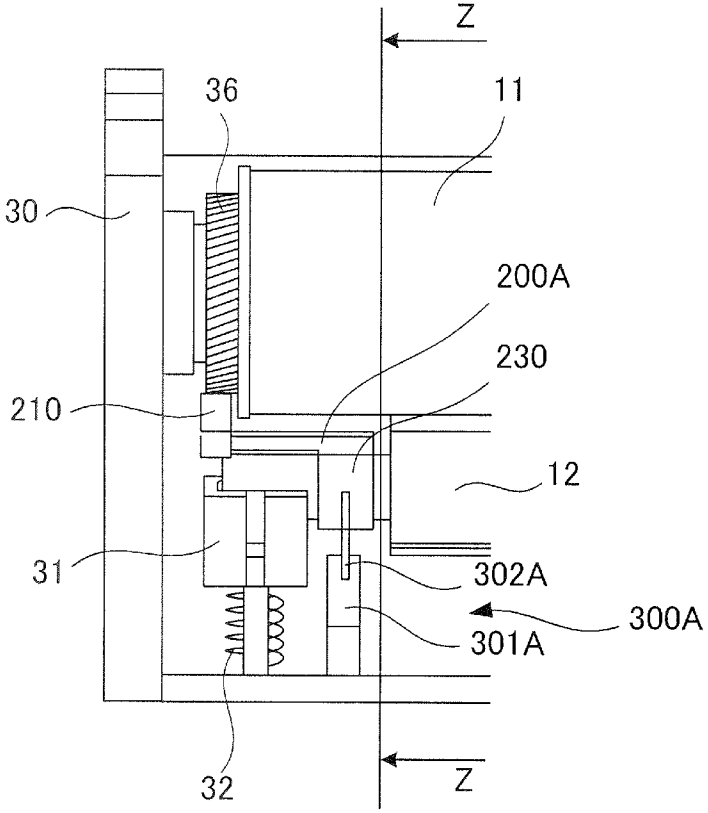
FIG. 15A is a partial side view of the drum unit according to the second exemplary embodiment illustrating the separation state thereof.

Here, as illustrated in FIGS. 15A and 15B, the distance between the abutting portion 302A and the abutted portion 301A in a state in which the separation holding state is taken and the separation member 200A has not moved in the direction to increase the distance between the swing center of the separation member 200A and the rotation center of the gear 36 is denoted by A. The distance A is preferably larger than 0. That is, a gap is preferably present between the abutting portion 302A and the abutted portion 301A in this state. To be noted, the separation holding state is a state in which the separation member 200A is holding the charging roller 12 at the separation position. In addition, the state in which the separation member 200A has not moved in the direction to increase the distance between the swing center of the separation member 200A and the rotation center of the gear 36 is a state in which the separation member 200A is pressed against the gear 36 and is not separated from the gear 36. In this state, the distance A is smaller than a length of overlap between a gear tooth 211*a* and an engagement recess portion 36*a* in a projecting direction of the gear tooth 211A as viewed in the rotation direction of the gear 36, that is, smaller than the amount of engagement between the gear tooth 211*a* and the engagement recess portion 36*a*. The length of overlap will be also referred to as an engagement amount B as illustrated in FIGS. 14A and 14B.

That is, as illustrated in FIGS. 14A to 15B, in the relationship between the distance A between the abutting portion 302A and the abutted surface 301Aa and the engagement amount B between the gear 36 and the engagement portion 211 in the separation holding state, the distance A is smaller than the engagement amount B in the sliding direction of the charging roller bearing 31A. That is, A<B holds. This configuration regulates the movement of the separation member 200A in the direction to increase the distance between the swing center of the separation member 200A and the rotation center of the gear 36 in the state in which the engagement portion 211 is engaged with the gear 36, such that the engagement between the engagement portion 211 and the gear 36 is not released.

According to this configuration, similarly to the first exemplary embodiment, the engagement between the engagement portion 211 and the gear 36 is less likely to be released even in the case where the charging roller 12 moves in a direction away from the photosensitive drum 11 against the urging force of the pressurizing spring 32 by being vibrated or dropped while the drum cartridge 100 is transported. That is, since the distance A is smaller than the engagement amount B, the abutting portion 302A abuts the abutted portion 301A before the engagement between the engagement portion 211 and the gear 36 is released, thus the movement of the separation member 200A is regulated, and the cancellation of the separation holding state is suppressed.

To be noted, also in the present exemplary embodiment, when the separation holding state is cancelled, since the separation member 200A is urged toward the photosensitive drum 11 together with the charging roller 12 by the pressurizing spring 32, the separation member 200A moves toward the photosensitive drum 11 in accordance with the release of engagement between the engagement portion 211 and the gear 36. In other words, the abutting portion 302A provided on the separation member 200A moves in a direction away from the abutted portion 301A while the separation member 200A is swinging. Therefore, the separation member 200A swings to cancel the separation holding state without interference between the abutting portion 302A and the abutted portion 301A.

Figure 16A:
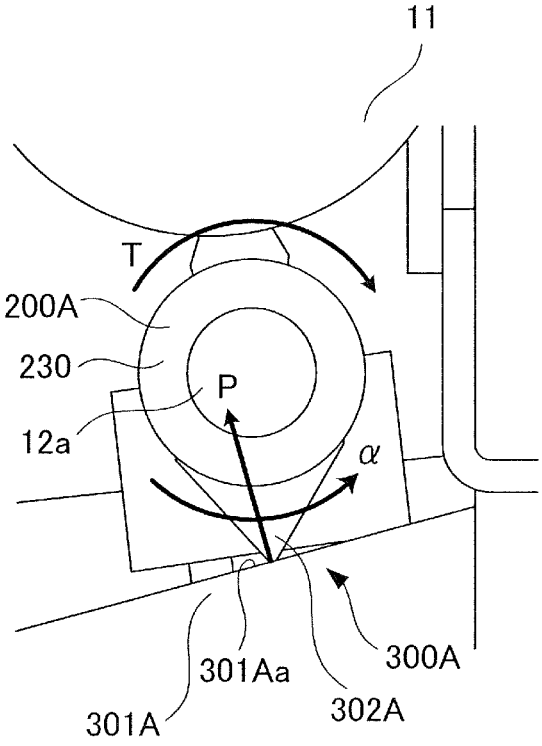
FIG. 16A is a diagram similar to FIG. 15B illustrating a direction of a torque acting when an abutting portion abuts an abutted portion in the second exemplary embodiment.

In addition, also in the present exemplary embodiment, rotation of the separation member 200A from the position at which the separation member 200A is in the separation holding state in a direction opposite to such a rotation direction that the separation holding state is automatically cancelled, that is, in a direction opposite to the predetermined direction α is regulated in the state in which the abutting portion 302A is abutting the abutted portion 301A. Therefore, as illustrated in FIG. 16A, the abutted portion 301A is formed such that a reaction force P in the normal direction applied to the abutting portion 302A when the abutting portion 302A abuts the abutted portion 301A acts in a direction to swing the separation member 200A in the direction opposite to the predetermined direction α.

Figure 16B:
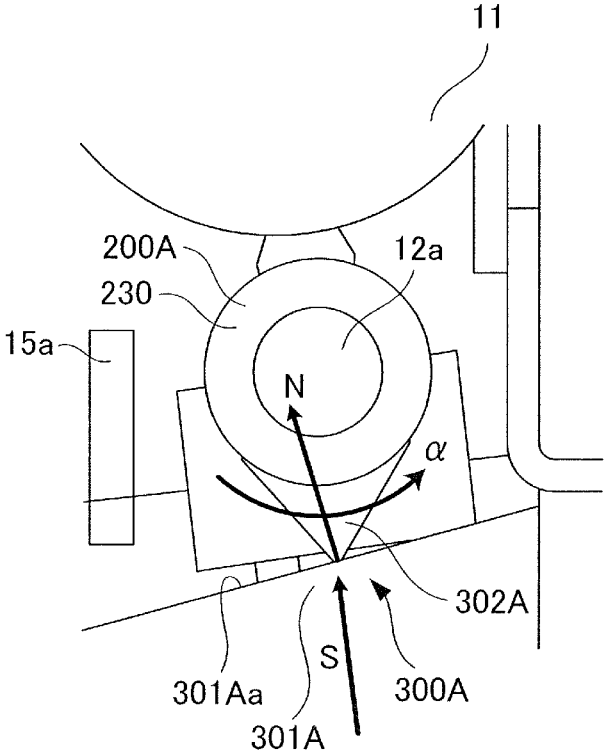
FIG. 16B is a diagram similar to FIG. 15B illustrating a relationship between an urging direction in which an urging force is applied to a separation member when the abutting portion abuts the abutted portion in the second exemplary embodiment and a normal vector at the abutting portion.

In the present exemplary embodiment, as illustrated in FIG. 16B, the abutted surface 301Aa of the abutted portion 301A is inclined in the direction opposite to the predetermined direction α with respect to a direction perpendicular to the urging direction S of the pressurizing spring 32 illustrated in FIG. 13A and so forth. In other words, the abutted surface 301Aa is made up of a surface inclined with respect to the sliding direction of the charging roller bearing 31A, which is the same direction as the urging direction S.

Specific description will be given below. The abutted surface 301Aa is formed as such an inclined surface that the reaction force P in the normal direction applied to the abutting portion 302A when the abutting portion 302A abuts the abutted surface 301Aa includes a force component that rotates the separation member 200A in the direction opposite to the predetermined direction α in which the separation member 200A rotates at the time of automatic cancellation. In other words, as illustrated in FIG. 16A, the reaction force P in the normal direction generates the torque T that rotates the separation member 200A in the direction opposite to the predetermined direction α.

Also in the present exemplary embodiment, as illustrated in FIG. 16B, the normal direction N of the abutted surface 301Aa is more toward the cleaning blade 15*a* side than a direction toward the rotation axis of the photosensitive drum 11, that is, than the urging direction S, in the sliding direction of the charging roller bearing 31A.

By forming the abutted surface 301Aa in an inclined shape in this manner, unintended cancellation of the separation holding state can be suppressed even in the case where, for example, A>B holds and the gear 36 and the engagement portion 211 are temporarily separated from each other. That is, when the separation member 200A is moved by the impact and the abutting portion 302A abuts the abutted surface 301Aa, the reaction force P in the normal direction that rotates the separation member 200A in the direction opposite to the direction in which the separation member 200A rotates at the time of automatic cancellation, that is, in the direction opposite to the predetermined direction α, is generated in the abutting portion 302A. Therefore, rotation of the separation member 200A in the predetermined direction α is suppressed, and cancellation of the separation holding state can be suppressed even when A>B holds.

Also in the present exemplary embodiment, even in the case where a vibration or an impact is applied to the drum cartridge and the separation member 200A has moved in the direction away from the gear 36, the movement of the separation member 200A is regulated, and release of engagement between the engagement portion 211 and the gear 36 can be suppressed. As a result of this, occurrence of unintended cancellation of the separation holding state of the photosensitive drum 11 and the charging roller 12 can be reduced.

Other Embodiments

Although a gear serving as a rotary member is provided on a rotation shaft of a photosensitive drum in the exemplary embodiments described above, the rotary member may be provided at a position deviated from the rotation shaft of the photosensitive drum. For example, the rotary member may be a gear that transmits rotation from a motor to the photosensitive drum. In addition, the rotary member may be driven separately from the photosensitive drum. Further, although a configuration in which the rotary member is a gear and an engagement portion includes a projection portion that engages with the gear has been described in the exemplary embodiments described above, a configuration in which the rotary member includes a projection portion and the engagement portion includes a recess portion that engages with the projection portion may be employed.

In addition, although a separation member is swingably provided on a rotation shaft of a charging roller in the exemplary embodiments described above, the separation member may be provided at a position deviated from the rotation shaft of the charging roller. Further, although a configuration in which the separation member swings in accordance with the rotation of the rotary member has been described in the exemplary embodiments described above, the engagement between the engagement portion and the rotary member may be released by, for example, sliding movement of the separation member caused by the rotation of the rotary member.

In addition, the photosensitive member may be a photosensitive belt or the like instead of the photosensitive drum. Examples of the photosensitive unit include, in addition to the drum cartridge described above, a process cartridge in which the drum cartridge and a developing unit are combined. Further, any image forming apparatus may be used as long as the image forming apparatus performs image formation by using a photosensitive member. For example, the image forming apparatus may be a copier, a printer, a facsimile machine, or a multifunctional apparatus having a plurality of functions of these.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-179899, filed Sep. 26, 2018, which is hereby incorporated by reference herein in its entirety.

What is claimed is:

1. A photosensitive unit comprising:

a rotatable photosensitive member;

a frame configured to hold the photosensitive member;

a charging roller provided to be movable between a contact position and a separation position and configured to charge a surface of the photosensitive member by being subjected to application of a voltage at the contact position, the charging roller being in contact with the surface of the photosensitive member at the contact position and being separated from the surface of the photosensitive member at the separation position;

an urging portion configured to urge the charging roller in a direction from the separation position toward the contact position;

a rotary member configured to rotate by receiving input of a driving force;

a separation member comprising an engagement portion capable of engaging with the rotary member, wherein the separation member is configured to hold the charging roller at the separation position against an urging force of the urging portion in a state in which the engagement portion is engaged with the rotary member, and, in a case in which the rotary member rotates, the separation member swings in accordance with rotation of the rotary member, engagement between the engagement portion and the rotary member is released, and a state in which the charging roller is held at the separation position is cancelled;

an abutting portion provided on the separation member; and an abutted portion that is provided on the frame and that is abutted by the abutting portion in a case in which the separation member moves in a direction to increase a distance between a swing center of the separation member and a rotation center of the rotary member in a state in which the engagement portion is engaged with the rotary member.

2. The photosensitive unit according to claim 1, wherein one of the engagement portion and the rotary member comprises a projection portion and another of the engagement portion and the rotary member comprises a recess portion, and wherein, in a state in which the separation member is holding the charging roller at the separation position and the separation member is not moving in the direction to increase the distance between the swing center of the separation member and the rotation center of the rotary member, a distance between the abutting portion and the abutted portion is less than a length of overlap between the projection portion and the recess portion in a projecting direction of the projection portion as viewed in a rotation direction of the rotary member.

3. The photosensitive unit according to claim 1, wherein the rotary member is a gear, wherein the engagement portion is a projection portion that engages with the gear, and wherein, in a state in which the separation member is holding the charging roller at the separation position and the separation member is not moving in the direction to increase the distance between the swing center of the separation member and the rotation center of the rotary member, a distance between the abutting portion and the abutted portion is less than an amount of engagement between the projection portion and the gear.

4. The photosensitive unit according to claim 1, wherein, in a case in which the rotary member rotates in the state in which the engagement portion is engaged with the rotary member, the separation member swings in a predetermined direction in accordance with rotation of the rotary member, and the engagement between the engagement portion and the rotary member is released, and wherein the abutted portion is formed such that a reaction force in a normal direction applied to the abutting portion in a case in which the abutting portion abuts the abutted portion acts in a direction to cause the separation member to swing in a direction opposite to the predetermined direction.

5. The photosensitive unit according to claim 4, wherein the abutted portion comprises an abutted surface that the abutting portion abuts, and wherein the abutted surface is inclined with respect to an urging direction of the urging portion.

6. The photosensitive unit according to claim 1, wherein the rotary member is provided on a rotation shaft of the photosensitive member so as to rotate together with the photosensitive member.

7. The photosensitive unit according to claim 1, wherein the separation member is swingably provided on a rotation shaft of the charging roller.

8. The photosensitive unit according to claim 1, further comprising:

a cleaning member provided to be movable between a roller contact position and a roller separation position and configured to clean the charging roller at the roller contact position, the cleaning member being in contact with a surface of the charging roller at the roller contact position and being separated from the surface of the charging roller at the roller separation position; and a cleaning member urging portion configured to urge the cleaning member in a direction from the roller separation position toward the roller contact position, wherein the separation member comprises a cleaning member engagement portion that engages with a part of the cleaning member in the state in which the engagement portion is engaged with the rotary member and thus holds the cleaning member at the roller separation position against an urging force of the cleaning member urging portion, and, in a case in which the separation member swings in a predetermined direction in accordance with the rotation of the rotary member and the engagement between the engagement portion and the rotary member is released, engagement between the cleaning member engagement portion and the part of the cleaning member is released and a state in which the cleaning member is held at the roller separation position is cancelled.

9. The photosensitive unit according to claim 8, wherein an urging direction of the urging portion and an urging direction of the cleaning member urging portion are approximately the same.

10. The photosensitive unit according to claim 1, wherein the abutting portion is provided further outside than the photosensitive member in a rotation axis direction of the photosensitive member, and wherein, the abutted portion is provided on a side wall of the frame opposite to an end portion of the photosensitive member in the rotation axis direction.

11. The photosensitive unit according to claim 1, further comprising:

a roller holding portion configured to hold an end portion of a rotation shaft of the charging roller, wherein the abutting portion is provided further inside than the roller holding portion in a rotation axis direction of the charging roller, and wherein the abutted portion is provided on a connecting portion that interconnects side walls of the frame provided at both end portions of the frame in a rotation axis direction of the photosensitive member.

12. The photosensitive unit according to claim 1, wherein the photosensitive member is a cylindrical photosensitive drum.

13. A photosensitive unit comprising:

a rotatable photosensitive member;

a charging roller provided to be movable between a contact position and a separation position and configured to charge a surface of the photosensitive member by being subjected to application of a voltage at the contact position, the charging roller being in contact with the surface of the photosensitive member at the contact position and being separated from the surface of the photosensitive member at the separation position;

an urging portion configured to urge the charging roller in a direction from the separation position toward the contact position;

a rotary member configured to rotate by receiving input of a driving force;

a separation member comprising an engagement portion capable of engaging with the rotary member, wherein the separation member is configured to hold the charging roller at the separation position against an urging force of the urging portion in a state in which the engagement portion is engaged with the rotary member, and, in a case in which the rotary member rotates, the separation member moves in accordance with rotation of the rotary member, engagement between the engagement portion and the rotary member is released, and a state in which the charging roller is held at the separation position is cancelled; and a regulation portion configured to, in a state in which the engagement portion is engaged with the rotary member, regulate movement of the separation member in such a direction that the separation member moves away from a rotation center of the rotary member in a radial direction of the rotary member, such that the engagement between the engagement portion and the rotary member is not released.

* * * * *